US007574166B2

(12) United States Patent
Murata et al.

(10) Patent No.: US 7,574,166 B2
(45) Date of Patent: Aug. 11, 2009

(54) ELECTROPHOTOGRAPHIC IMAGE-RECEIVING SHEET AND IMAGE-FORMING PROCESS USING THE SAME

(75) Inventors: Masataka Murata, Shizuoka (JP); Yoshisada Nakamura, Shizuoka (JP); Yasutomo Goto, Shizuoka (JP); Yoshio Tani, Shizuoka (JP); Yutaka Nogami, Kanagawa (JP); Yoshio Kanesawa, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 571 days.

(21) Appl. No.: 11/347,222

(22) Filed: Feb. 6, 2006

(65) Prior Publication Data

US 2006/0127651 A1 Jun. 15, 2006

Related U.S. Application Data

(62) Division of application No. 10/366,570, filed on Feb. 14, 2003, now abandoned.

(30) Foreign Application Priority Data

| | | |
|---|---|---|
| Feb. 15, 2002 | (JP) | 2002-038158 |
| Aug. 23, 2002 | (JP) | 2002-242877 |
| Jan. 27, 2003 | (JP) | 2003-017267 |

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS

| | | | |
|---|---|---|---|
| 5,532,056 | A | 7/1996 | Satoh et al. |
| 5,691,039 | A | 11/1997 | Rimai et al. |
| 5,804,351 | A | 9/1998 | Takano et al. |
| 5,885,698 | A | 3/1999 | Takehana et al. |
| 6,022,662 | A | 2/2000 | Matsumura et al. |
| 6,042,985 | A | 3/2000 | Matsuda et al. |
| 6,294,302 | B1 | 9/2001 | Serizawa et al. |
| 6,338,929 | B1 | 1/2002 | Hagi et al. |
| 6,416,918 | B2 | 7/2002 | Matsumura et al. |
| 6,743,502 | B2 | 6/2004 | Ogino et al. |
| 6,800,359 | B2 | 10/2004 | Nakamura et al. |
| 6,818,283 | B2 | 11/2004 | Nakamura et al. |
| 2001/0053492 | A1 | 12/2001 | Suwabe et al. |

FOREIGN PATENT DOCUMENTS

| | | |
|---|---|---|
| EP | 0778500 A | 6/1997 |
| EP | 0831378 A | 3/1998 |
| JP | 5127413 A | 5/1993 |
| JP | 05-249798 | 9/1993 |
| JP | 06-250537 | 9/1994 |

(Continued)

*Primary Examiner*—David M Gray
*Assistant Examiner*—Ryan D Walsh
(74) *Attorney, Agent, or Firm*—Sughrue Mion, PLLC

(57) ABSTRACT

An electrophotographic image-receiving sheet which includes a support, a toner-receiving layer which contains thermoplastic resin. The fixing belt electrophotographic sheet has an optimized separation force at a surface of the electrophotographic image-receiving sheet from the toner-receiving layer. Having a highly improved long-run properties, the fixing belt electrophotographic sheet realizes a stable paper feed without offset, and provides a good quality image with rich photographic features.

24 Claims, 3 Drawing Sheets

FOREIGN PATENT DOCUMENTS

| | | |
|---|---|---|
| JP | 09-218527 | 8/1997 |
| JP | 09-319131 | 12/1997 |
| JP | 10-268679 | 10/1998 |
| JP | 11-052604 A | 2/1999 |
| JP | 11-052605 A | 2/1999 |
| JP | 11-052606 A | 2/1999 |
| JP | 11-184300 | 7/1999 |
| JP | 2001-083832 | 3/2001 |

ELECTROPHOTOGRAPHIC IMAGE-RECEIVING SHEET AND IMAGE-FORMING PROCESS USING THE SAME

This is a divisional of application Ser. No. 10/366,570 filed Feb. 14, 2003 now abandoned.

BACKGROUND OF THE INVENTION

1. Field of the Invention

The present invention relates to an electrophotographic image-receiving sheet and an image-forming process, especially to an electrophotographic image-receiving sheet with substantially improved long-run properties suitable for use in fixing belt electrophotography, and to an image-forming process which employs the electrophotographic image-receiving sheet.

2. Description of the Related Art

In dry treatment, the electrophotography method has quick printing speed and is the printing method currently used for copiers or the output device of a personal computer. This electrophotography method transfers a toner image to an image-receiving sheet, passes this through a fixing part which is heated and/or pressurized, for example, a fixing roller or a fixing belt, and fixes the toner image onto an image-receiving sheet. To improve gloss and to approach the appearance of a photograph, it has been proposed that this image-receiving sheet, in addition to a general-purpose paper (regular paper, paper of fine quality, or the like), may be an image-receiving material for electrophotography which has a toner image-receiving layer containing a thermoplastic resin on a support (Japanese Patent Application Laid-Open (JP-A) Nos. 04-212168, 08-211645, or the like). In order to prevent offset when the image-receiving material peels away from the aforesaid fixing part in such a toner image-receiving layer, to prevent cracks in the toner image-receiving layer and to improve the quality of the image, it has been proposed to add a wax which has a given release effect (Japanese Patent Application Laid-Open (JP-A) Nos. 11-52604, 11-52605, 11-52606 and 11-212292, or the like).

However, the amount of releasing agent in the related art is optimized for the fixing roller electrophotography method, and the amount required by the image-receiving sheet used by the fixing belt electrophotography method does not necessarily correspond. That is, in the fixing roller electrophotography method, the image-receiving sheet separates from the fixing roller immediately after being heated by the fixing roller. Therefore, in order to improve the releasing characteristic of the fixing roller from image-receiving sheet, a large amount of releasing agent was added to the layer comprising the surface of the image-receiving sheet which comes in contact with the fixing roller, as described in JP-A No. 11-212292.

Moreover, in the aforementioned fixing belt electrophotography method, a surface of the image-receiving sheet and the surface of the fixing belt must be in intimate contact, while the image-receiving sheet is transported on the fixing part. Thus, if the releasing characteristic between the fixing belt as a fixing part and the image-receiving sheet is high, problems arise. This is because, in the fixing belt electrophotography method, a glossy image is not obtained if the fixing belt and the image-receiving sheet are not in contact while being transported in the fixing part. Therefore, it is necessary to adjust the releasing characteristic of the fixing belt and image-receiving sheet to an extent which brings them into suitable contact while being transported the fixing part, and allows them to separate without causing an offset when the image-receiving sheet is released from the fixing belt. It is also necessary to optimize the amount of the releasing agent added to the layer forming the surface of the image-receiving sheet which comes in contact with the fixing belt in the fixing belt electrophotography method.

SUMMARY OF THE INVENTION

The present invention is aimed to solve various problems in the related art, and to achieve the following objects. Namely, it is a first object of the present invention to provide an electrophotographic image-receiving sheet which comprises a toner image-receiving layer containing a thermoplastic resin on a support. By using an image-receiving sheet with optimized releasing force between the surface of the fixing belt and the surface of the image-receiving sheet on the toner image-receiving layer side of the above-mentioned support, stable paper provision without offset is obtained, and an image-receiving sheet for fixing belt electrophotography with good brilliance, which is rich in photographic feature and provides a good image, is achieved.

It is a second object of the present invention to provide a glossy image-receiving sheet for fixing belt electrophotography wherein the amount of the releasing agent added to the layer forming the surface of the electrophotographic image-receiving sheet is optimized, so that there is no offset to the fixing roller and fixing belt, and long run properties are largely improved.

It is a third object of the present invention to provide an image-forming process which provides a stable paper feed without offset to the fixing roller and fixing belt, and which forms a good image having better brilliance than ever, and rich in photographic features, even if an oil-less apparatus without fixing oil is used.

An electrophotographic image-receiving sheet according to the present invention comprises a support, and a toner-receiving layer which contains a polymer on the support.

The electrophotographic image-receiving sheet is utilized for an apparatus for elecrophotography having a fixing belt, and a separation force at a surface of the electrophotographic image-receiving sheet from the toner-receiving layer is 1 N/m to 20 N/m, when a temperature at a surface of the electrophotographic image-receiving sheet is one of 50° C. and 90° C.

Accordingly, long run properties largely is improved, a stable paper feed without offset is achieved, and a good image with high brilliance and rich photographic features can be obtained.

An image-forming process according to the present invention include the step of forming a toner image on an electrophotographic image-receiving sheet; the step of heating and pressuring a surface of the electrophotgrahic image-receiving sheet on which the toner image is formed with a fixing bet and a roller; and the step of cooling the surface, so as to separate the surface from the fixing belt.

The image-forming process of the present invention employs the electrophotographic image-receiving sheet of the present invention.

Accordingly, the separation of the electrophotographic image-receiving sheet and toner is prevented, and offset of the electrophotographic image-receiving sheet and toner component can be prevented, even if an oil-less apparatus without fixing oil is used. Moreover, a stable paper feed can be achieved, and a good image with high brilliance and rich photographic features can be obtained.

DESCRIPTION OF THE PREFERRED EMBODIMENTS

Figure 1:
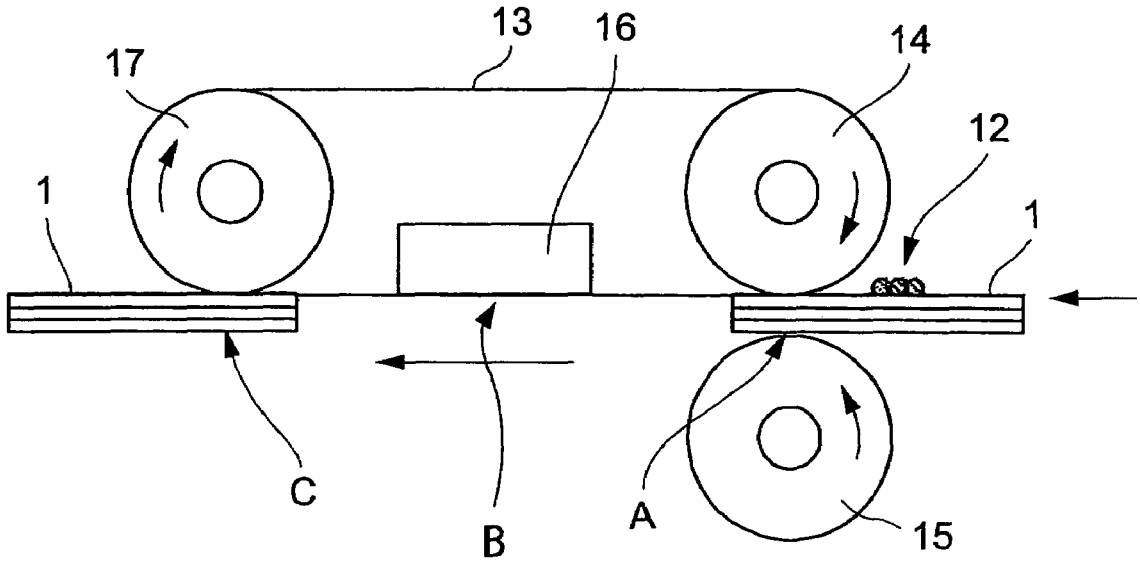
FIG. 1 is a schematic view showing an example of an apparatus for electrophotography having a fixing belt according to the present invention.

<Relation Between a Surface of a Fixing Belt and a Surface of an Image-receiving Sheet on the Toner Image-receiving Layer Side from a Direction of the Support>

The electrophotographic image-receiving sheet of the present invention requires that the separation force between the surface of the fixing belt and the surface of the electrophotographic image-receiving sheet on a side of the toner image-receiving layer seen the support, lies within a certain limits. This is because, in the process for electrophotography using the fixing belt, it is required not only to improve the separation force of surface of the image-receiving sheet from a surface of the fixing belt, but also to ensure that the surfaces of the fixing belt and electrophotographic image-receiving sheet are in intimate contact, while the image-receiving sheet is transported in the fixing part.

Hereinafter, the relation will be described in detail, taking the image-forming process using the electrophotographic image-receiving sheet shown in FIG. 1 as an example. However, the image-forming process of the present invention is not limited to the process shown in FIG. 1.

First, in the electrophotographic image-receiving sheet (1) with adhering toner, toner (12) is melted, heated and pressurized by a heating/pressurizing part (A) in which pressurizing is provided, and brought in intimate contact with the fixing belt (13). Thereafter, it is cooled in a cooling part (B) and the image-receiving sheet (1) separates from the fixing belt (13) in a separating part (C). The surface of the fixing belt (13) and the surface of the image-receiving sheet (1) are held in intimate contact, while the image-receiving sheet (1) is transported on the fixing parts (A) to (C).

As the surface of the fixing belt (13) and the surface of the image-receiving sheet (1) are held in intimate contact while the image-receiving sheet (1) is transported in the fixing parts (A) to (C), the toner adhering to the toner image-receiving layer is precisely fixed when the surface of the fixing belt and the surface of image-receiving sheet move through the fixing parts (A) to (C) without spreading on the image-receiving sheet. Also, as the toner is pressurized by the fixing belt, and cooled and solidified in a state where it is completely embedded in the toner image-receiving layer, there is no image unevenness. Therefore, a glossy, flat and smooth toner image can be obtained.

Further, in the separating part (C), the surface of the fixing belt and the surface of the image-receiving sheet become separated away from each other with at least a certain level of separation force. Accordingly, offset derived from the adhesion of a portion of the image, or a portion of the materials which consist of the image-receiving sheet, and trouble of paper jam derived from the adhesion of the image-receiving sheet itself to the fixing belt are more likely to be prevented.

To satisfy these two points, in the electrophotographic image-receiving sheet provided with a toner image-receiving layer containing a thermoplastic resin on the support of the present invention, the separation force at the surface of the electrophotographic image-receiving sheet from the toner-receiving layer is 1 N/m to 20 N/m, and preferably 2 N/m to 20 N/m, when a temperature at the surface of the image-receiving sheet is 50° C.

The separation force at the electrophotographic image-receiving sheet from the toner-receiving layer is 1 N/m to 20 N/m, more preferably 1 N/m to 18 N/m, and still more preferably 1 N/m to 15 N/m, when a temperature at the surface of the image-receiving sheet is 90° C.

If the separation force is 20 N/m or less at 50° C., the image retains good brilliance even when it separates from the fixing belt. As long as the separation force is 1 N/m or higher at 90° C., the surface of the fixing belt and the surface of the image-receiving sheet remain in intimate contact without separating away from each other, while the image-receiving sheet is transported in the fixing part.

Figure 2:
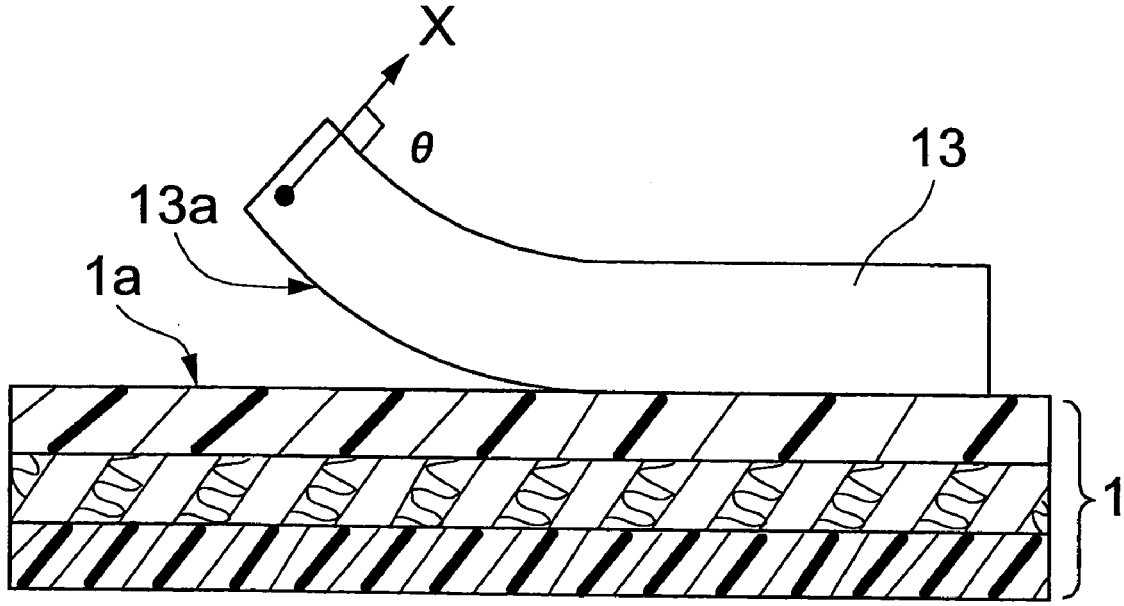
FIG. 2 is a schematic view showing an example of measuring the releasing force of the present invention.

Herein, the separation force is measured as follows, referring to FIG. 2.

First, samples are prepared by cutting some of the electrophotographic image-receiving sheet (1) and fixing belt (13) to suitable sizes. In the actual fixing belt electrophotography process, the surface where the fixing belt (13) contacts the image-receiving sheet (1), namely a surface of the fixing belt (13*a*), is brought in contact with the surface of the image-receiving sheet (1) which contacts the fixing belt (13), namely the image-receiving surface (1*a*) on the toner image-receiving layer side of the support. Next, the image-receiving sheet is heated for 10 seconds to 1 minute, so that the fixing belt having each of the temperatures and the image-receiving sheet surface becomes 30° C. to 150° C. Then, one end (the left-hand end in FIG. 2) of the fixing belt (13) is held, and is separated away at a certain velocity of 20 mm to 60 mm per second, so that the angle (θ) between the fixing belt (13) and the separating direction (X) is maintained at 90°. The force applied in the separating direction (X) is the separation force.

In order to adjust the separation force between the surface of the fixing belt and the surface of the image-receiving sheet, it is also important to select the material of the surface of the fixing belt and the material of the surface of the image-receiving sheet.

Hereinafter, the materials of the fixing belt and the surface of the fixing belt, and the materials of the image-receiving sheet and the surface of the image-receiving sheet, in order to obtain the separation force of the present invention, will be described.

<Fixing Belt>

Herein, it is convenient if the fixing belt used in the image-forming apparatus is an endless belt formed from a material such as polyimide, electroplated nickel, aluminum, or the like.

The material for a surface of the fixing belt may be silicone materials or fluorine materials. Specific examples of the materials for the surface of the fixing belt include one or more materials selected from silicone rubber, fluorinated rubber, silicone resin, fluorinated resin, and the like. The materials are suitable because the materials are less likely to become adhered to a polymer contained in a surface of the image-receiving sheet, and are more likely to become separated from the polymer. The materials are hence suitable to have a separation force in a desired range.

Examples of the materials for a surface of the fixing belt include silicone cross-linking fluorinated polyether such as silicon rubber, polytetrafluoroethyleneperfluoroalkylvinylether copolymer (PFA), SIEFL (a registered trade mark: manufactured by Shin-Etsu Chemical Co., Ltd.), or the like; poyltetrafluoroethylene (PTFE), tetrafluoroethylenehexafluoroethylene propylene copolymer (FEP), perfluoroalkoxyalkane, silicone-modified acryl polymer, and the like. Of these, it is preferred to provide a layer of fluorocarbon siloxane rubber having a uniform thickness on the surface of the fixing belt, or provide a layer of silicone rubber having uniform thickness on the surface of the fixing belt, and then provide a layer of fluorocarbon siloxane rubber on the surface of the layer of silicone rubber.

It is preferred that the fluorocarbon siloxane rubber has a perfluoroalkyl ether group and/or a perfluoroalkyl group in the main chain.

Examples of the fluorocarbon siloxane rubber include (A) a fluorocarbon polymer having a fluorocarbon siloxane of the following Formula 1 as its main component, and containing aliphatic unsaturated groups, (B) an organopolysiloxane and/or fluorocarbon siloxane containing two or more ═SiH groups in one molecule, and 1 to 4 times more the molar amount of ═SiH groups than the amount of aliphatic unsaturated groups in the aforesaid fluorocarbon siloxane rubber, (C) a filler, and (D) an effective amount of catalyst.

The fluorocarbon polymer having (A) as a component comprises a fluorocarbon siloxane containing a repeating unit represented by the following Formula 1 as its main component, and contains aliphatic unsaturated groups.

Formula 1

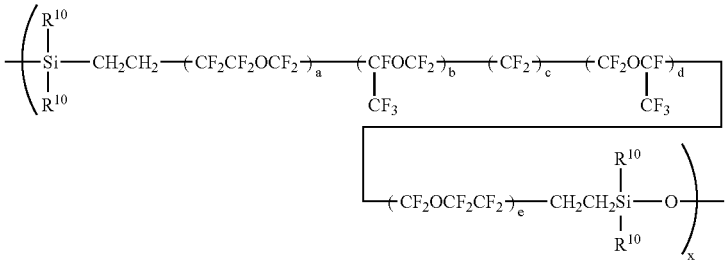

Herein, in the aforesaid Formula 1, $R^{10}$ is a non-substituted or substituted monofunctional hydrocarbon group preferably containing 1 to 8 carbon atoms, preferably an alkyl group containing 1 to 8 carbon atoms or an alkenyl group containing 2 to 3 carbon atoms, and particularly preferably a methyl group. "a," and "e" are respectively 0 or 1; "b," and "d" are respectively an integer of 1 to 4, and "c" is an integer of 0 to 8. "x" is an integer of 1 or more, and preferably 10 to 30.

An example of this component (A) include a substance shown by the following Formula 2:

Formula 2

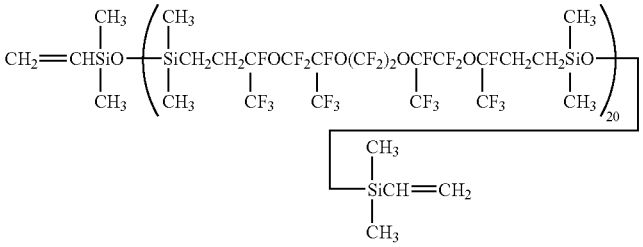

In Component (B), one example of the organopolysiloxane comprising ═SiH groups is an organohydrogenpolysiloxane having at least two hydrogen atoms bonded to silicon atoms in the molecule.

In the fluorocarbon siloxane rubber composition used in the present invention, when the organocarbon polymer of Component (A) comprises an aliphatic unsaturated group, the aforesaid organohydrogenpolysiloxane may be used as a curing agent. Namely, in this case, the cured product is formed by an addition reaction between aliphatic unsaturated groups in the fluorocarbon siloxane, and hydrogen atoms bonded to silicon atoms in the organohydrogenpolysiloxane.

Examples of these organohydrogenpolysiloxanes are the various organohydrogenpolysiloxanes used in an addition-curing silicone rubber composition.

It is generally preferred that the organohydrogenpolysiloxane is blended in such a proportion that the number of "═SiH groups" therein is at least one, and particularly 1 to 5, relative to one aliphatic unsaturated hydrocarbon group in the fluorocarbon siloxane of Component (A).

It is preferred that in the fluorocarbon containing ═SiH groups, one unit of the Formula 1 or $R^{10}$ in the Formula 1 is a dialkylhydrogensiloxane group, the terminal group is a ═SiH group such as a dialkylhydrogensiloxane group, a silyl group, or the like. An example of the fluorocarbon includes those represented by the following Formula 3.

Formula 3

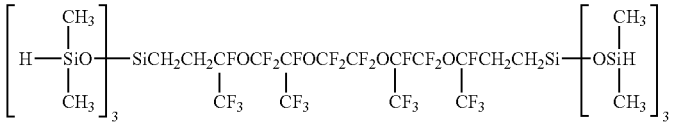

The filler, which is Component (C), may be various fillers used in ordinary silicone rubber compositions. Examples are reinforcing fillers such as mist silica, precipitated silica, carbon powder, titanium dioxide, aluminum oxide, quartz powder, talc, sericite, bentonite, or the like; fiber fillers such as asbestos, glass fiber, organic fibers or the like.

Examples of the catalyst, which is Component (D), include those any known as an addition reaction catalyst in the art. Specific examples of the catalyst include chloroplatinic acid, alcohol-modified chloroplatinic acid, complexes of chloroplatinic acid and olefins, platinum black or palladium supported on a support such as alumina, silica, carbon, or the like, and Group VIII elements of the Periodic Table or compounds thereof such as complexes of rhodium and olefins, chlorotris (triphenylphosphine) rhodium (an Wilkinson catalyst), rhodium (III) acetyl acetonate, or the like. It is preferred to dissolve these complexes in an alcohol solvent, an ether solvent, a hydrocarbon solvent, or the like.

Various blending agents may be added to the fluorocarbon siloxane rubber composition used in the present invention to the extent that the blending agents do not interfere with the purpose of the present invention which is to improve solvent resistance. For example, dispersing agents such as diphenylsilane diol, low polymer chain end hydroxyl group-blocked dimethylpolysiloxane, hexamethyl disilazane, heat resistance improvers such as ferrous oxide, ferric oxide, cerium oxide, octyl acid iron, or the like; and colorants such as pigments or the like, may be added as a compounding agent, if necessary.

The fixing belt according to the present invention is obtained by covering the surface of a heat resistant resin or metal belt with the aforesaid fluorocarbon siloxane rubber composition, and heat and cure it. The composition may be diluted to form a coating solution with a solvent such as m-xylene hexafluoride, benzotrifluoride, or the like. The coating solution is then applied by an ordinary coating method such as spin coating, dip coating, knife coating, or the like. The heat curing temperature and time can be conveniently selected. The heat curing temperature and time can be suitably selected within the ranges of 100° C. to 500° C. and 5 seconds to 5 hours, according to a type of the belt, a process for manufacturing the belt, or the like.

The materials of a surface of the fixing belt are preferably formed on the base material with a thickness of 10 μm to 100 μm, and more preferably 20 μm to 50 μm. Separation of toners and an electrophotographic image-receiving sheet, and offsetting of an image-receiving sheet and toner components can be prevented, by applying the materials onto the base material.

<Electrophotographic Image-receiving Sheet>

Figure 3:
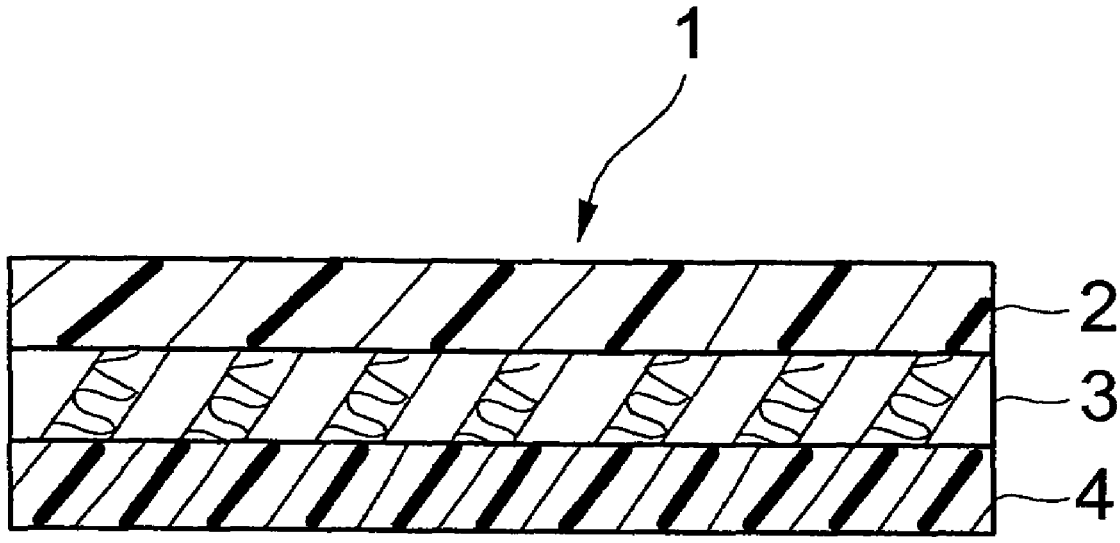
FIG. 3 is a schematic cross-sectional view showing an example of an electrophotographic image-receiving sheet according to the present invention.

The aforesaid electrophotographic image-receiving sheet may, for example, comprise a toner image-receiving layer (2) above a support (3), a back layer (4) if desired, as shown in FIG. 3. Other layers suitably chosen as necessary, for example, a surface protective layer, interlayer, undercoat, cushion layer, charge regulation (prevention) layer, reflective layer, color adjustment layer, storage improvement layer, anti-adhesion layer, anticurl layer, smoothing layer, and the like. These layers may be single layer structures or may be laminated structures.

[Support]

To give the electrophotographic image-receiving sheet of the present invention a photographic feature, the support is a support having a low light transmittance of preferably 30% or less, more preferably 20% or less, and still more preferably 15% or less.

The light transmittance can be measured by a direct-reading haze meter (Suga Test Instruments HGM-2DP).

The support preferably has a surface center line average roughness of 0.01 μm to 5 μm, and more preferably 0.05 μm to 3 μm.

By adjusting the center line average roughness within the above range, an electrophotographic image-receiving sheet with outstanding characteristics, such as paper transport properties, can be provided.

[Support]

There is no particular limitation on the aforesaid support which can be suitably selected according to the purpose. Examples of the support include raw paper, synthetic paper, synthetic resin sheet, coated paper, laminated paper, and the like. These supports may have a single-layer structure, or a laminated layer structure in which two or more layers are disposed.

—Raw Paper—

The materials of the raw paper (including synthetic paper) may be those types of raw paper used as supports in the art, which can be selected from various kinds of materials without any particular limitation. Examples of the materials of the raw paper include natural pulp selected from needle-leaf trees and broadleaf trees, synthetic pulp made from plastics materials such as polyethylene, polypropylene, or the like, a mixture of the natural pulp and the synthetic pulp, and the like.

Regarding pulps used as materials for raw paper, from the viewpoint of good balance between surface flatness and smoothness of the raw paper, rigidity and dimensional stability (curl), broadleaf tree bleached kraft pulp (LBKP) is preferred. Needle-leaf bleached kraft pulp (NBKP), broadleaf tree sulfite pulp (LBSP), and the like can also be used.

Regarding the pulp fiber, it is appropriate to use mainly broadleaf pulp having short fiber length.

A beater or a refiner, or the like, can be used for beating the pulp. Various additives, for example, fillers, dry paper reinforcers, sizing agents, wet paper reinforcers, fixing agents, pH regulators or other agents, or the like may be added, if necessary, to the pulp slurry (hereafter, may be referred to as pulp paper material) which is obtained after beating the pulp.

Examples of fillers include calcium carbonate, clay, kaolin, white clay, talc, titanium oxide, diatomaceous earth, barium sulfate, aluminum hydroxide, magnesium hydroxide, and the like.

Examples of dry paper reinforcers include cationic starch, cationic polyacrylamide, anionic polyacrylamide, amphoteric polyacrylamide, carboxy-modified polyvinyl alcohol, and the like.

Examples of sizing agents include a compound and the like which contains rosin derivatives such as aliphatic acid salts, rosin, maleic rosin or the like; paraffin wax, and the like; higher aliphatic acids such as alkyl ketene dimer, alkenyl succinic anhydride (ASA), epoxy aliphatic acid amides, or the like.

Examples of wet paper reinforcers include polyamine polyamide epichlorohydrin, melamine resin, urea resin, epoxy polyamide resin, and the like.

Examples of fixing agents include polyfunctional metal salts such as aluminum sulfate, aluminum chloride, or the like; cationic polymers such as cationic starch, or the like.

Examples of pH regulators include caustic soda, sodium carbonate, and the like. Examples of other agents include defoaming agents, dyes, slime control agents, optical whitening agents, and the like.

Moreover, softeners can also be added if necessary. An example of the softeners is indicated on pp. 554-555 of *Paper and Paper Treatment Manual* (Shiyaku Time Co.) (1980).

Treatment liquids used for sizing a surface include water-soluble polymers, sizing agents, waterproof materials, pigments, pH regulators, dyes, optical whitening agents, and the like. Examples of water-soluble polymers include cationic starch, polyvinyl alcohol, carboxy-modified polyvinyl alcohol, carboxymethylcellulose, hydroxyethylcellulose, cellulose sulfite, gelatin, casein, sodium polyacrylate, styrene-maleic anhydride copolymer sodium salt, sodium polystyrene sulfonate, and the like.

Examples of the waterproof materials include styrene-butadiene copolymer, ethylene-vinyl acetate copolymer, polyethylene, latex emulsions of vinylidene chloride copolymer or the like, polyamide polyamine epichlorohydrin, and the like.

Examples of the pigments include calcium carbonate, clay, kaolin, talc, barium sulfate, titanium oxide, and the like.

Examples of the raw paper materials include the aforesaid natural pulps, synthetic pulp paper, mixtures of the natural pulp and the synthetic pulp, various types of composite papers, and the like.

As for the above raw paper, to improve the rigidity and dimensional stability (curl) of electrophotographic image-receiving paper, it is preferred that the ratio (Ea/Eb) of the longitudinal Young's modulus (Ea) and the lateral Young's modulus (Eb) is within the range of 1.5 to 2.0. If the Ea/Eb value is less than 1.5 or more than 2.0, the rigidity and curl of the electrophotographic image-receiving paper tend to deteriorate, and may interfere with paper when transferred.

In the present invention, the Wang research smoothness of a surface of the toner image-receiving layer of the raw paper is 210 seconds or more, and preferably 250 seconds or more. If the Wang research smoothness is less than 210 seconds, the quality of the toner image is poor. There is no particular limitation on the upper limit. However, in practice, about 600 seconds, and preferably about 500 seconds are suitable.

The present invention solves various problems by adopting a Wang research smoothness of 210 seconds or more which is far larger than the Wang research smoothness adopted in the related art.

Here, the Wang research smoothness refers to the smoothness specified by the JAPAN TAPPI No. 5 B method.

It has been found that in general, the "tone" of the paper differs based on differences in the way the paper is beaten, and the elasticity (modulus) of paper from paper-making after beating can be used as an important indication of the "tone" of the paper.

The elastic modulus of the paper can be calculated from the following equation by using the relation of the density and the dynamic modulus which shows the physical properties of a viscoelastic object, and by measuring the velocity of sound propagation in the paper using an ultrasonic oscillator.

$$E=\rho c^2(1-n^2)$$

[E=dynamic modulus, ρ=density, c=velocity of sound in paper, n=Poisson's ratio]

As n=0.2 or so in a case of ordinary paper, there is not much difference in the calculation, even if the calculation is performed by the following equation:

$$E=\rho c^2$$

Namely, if the density of the paper and acoustic velocity can be measured, the elastic modulus can easily be calculated. In the above equation, when measuring acoustic velocity, various instruments known in the art may be used, such as a Sonic Tester SST-110 (Nomura Shoji Co., Ltd.) or the like.

It is preferred that the thickness of the raw paper is 30 μm to 500 μm, more preferred that it is 50 μm to 300 μm and still more preferred that it is 100 μm to 250 μm. The weighting of the raw paper is for example preferably 50 g/m$^2$ to 250 g/m$^2$, and more preferably 100 g/m$^2$ to 200 g/m$^2$.

Specifically, the raw paper may be a fine quality paper, for example, the paper described in *Basic Photography Engineering—Silver Halide Photography*, CORONA PUBLISHING CO., LTD. (1979) pp. 223-240, edited by the Institute of Photography of Japan.

In the aforesaid raw paper, it is preferred to use pulp fibers having a fiber length distribution as disclosed, for example, in Japanese Patent Application Laid-Open (JP-A) No. 58-68037 (e.g., the sum of 24-mesh screen residue and 42-mesh screen residue is 20% by mass to 45% by mass, and 24-mesh screen residue is 5% by mass or less) in order to give the desired center line average roughness to the surface. Moreover, the center line average roughness can be adjusted by heating and giving a pressure to a surface of the raw paper, with a machine calendar, super calendar, or the like.

—Synthetic Resin Sheet—

The synthetic resin sheet may be a synthetic resin formed in the shape of a sheet (film). The synthetic resins sheet may for example be obtained by extruding polyolefin resin such as polypropylene resin or the like, or polyester resins such as polyethylene-terephthalate resin, or the like, into a shape of a sheet.

—Coated Paper—

The aforesaid coated paper is a paper or sheet on one-side or both sides of which rubber latex, polymer materials, or the like is coated. The amount to be coated differs according to the use. Examples of the coated papers include art paper, cast coated paper, Yankee paper, and the like.

If a resin is used to coat the surface of raw paper, for example, it is appropriate to use a thermoplastic resin. Examples of the thermoplastic resins include the thermoplastic resins of the following (a) to (h).

(a) Polyolefin resins such as polyethylene resin, polypropylene resin, or the like; copolymer resins of an olefin such as ethylene or propylene with other vinyl monomers; acrylic resins, and the like.

(b) Thermoplastic resins containing at least an ester bond. For example, polyester resins obtained by condensation of dicarboxylic acid components (these dicarboxylic acid components may be substituted by a sulfonic acid group, a carboxyl group, and the like.) and alcoholic components (these alcoholic components may be substituted by the hydroxyl group, and the like), polyacrylic acid ester resins or polymethacrylic acid ester resins such as polymethylmethacrylate, polybutylmethacrylate, polymethylacrylate, polybutylacrylate, and the like; polycarbonate resin, polyvinyl acetate resin, styrene acrylate resin, styrene-methacrylic acid ester copolymer resin, vinyltoluene acrylate resin, and the like.

Specifically, the resins described in JP-A Nos. 59-101395, 63-7971, 63-7972, 63-7973, 60-294862, or the like may be mentioned.

Examples of commercial products include Bailon 290, Bailon 200, Bailon 280, Bailon 300, Bailon 103, Bailon GK-140 and Bailon GK-130 from Toyobo Co., Ltd; Tufton NE-382, Tufton U-5, ATR-2009 and ATR-2010 from Kao Corporation; Eritel UE3500, UE3210, XA-8153, KZA-7049 and KZA-1449 from Unitika Ltd.; polyester-TP-220 and R-188 from The Nippon Synthetic Chemical Industry Co., Ltd.; and thermoplastic resins in the high loss series from SEIKO CHEMICAL INDUSTRIES CO., LTD., and the like.

(c) Polyurethane resins, and the like.

(d) Polyamide resins, urea resins, and the like.

(e) Polysulfone resins, and the like.

(f) Polyvinyl chloride resin, polyvinylidence chloride resin, vinyl chloride-vinyl acetate-copolymer resin, vinyl chloride-vinyl propionate copolymer resin, and the like.

(g) Polyol resins such as polyvinyl butyral, and cellulose resins such as ethyl cellulose resin and cellulose acetate resin.

(h) Polycaprolactone resin, styrene-maleic anhydride resin, polyacrylonitrile resin, polyether resins, epoxy resins, phenol resins, and the like.

One of the aforesaid thermoplastic resins may be used either alone or in combination of two or more.

A thickness of the thermoplastic resin layer is preferably 5 μm to 100 μm, and more preferably 15 μm to 50 μm. A thermoplastic resin layer provided on a surface of paper and a thermoplastic resin layer provide on a back surface of the paper may have either the same or different components, physical properties, thickness, and structure.

—Laminated Paper—

The aforesaid laminated paper comprises various kinds of sheets or films of resins, rubber, polymer, or the like on a sheet such as raw paper or the like. Examples of laminating materials include polyolefin, polyvinyl chloride, polyethylene terephthalate, polystyrene, polymethacrylate, polycarbonate, polyimide, triacetyl cellulose, and the like. These resins may be used either alone or in combination of two or more.

The aforesaid polyolefin is generally formed using a low density polyethylene. In order to improve the heat-resisting properties of the support, it is preferred to use polypropylene, a blend of polypropylene and polyethylene, high density polyethylene, a blend of high density polyethylene and low density polyethylene, or the like. From the viewpoints of cost and suitability for lamination, it is most preferred to use the blend of high density polyethylene and low density polyethylene.

The aforesaid blend of high density polyethylene and low density polyethylene is used in a blending ratio (mass ratio) of, for example, 1/9 to 9/1. This blending ratio is preferably 2/8 to 8/2, and more preferably 3/7 to 7/3. When forming a thermoplastic resin layer on both sides of this support, it is preferred to use high density polyethylene, or the blend of high density polyethylene and low density polyethylene, on the undersurface of the support. There is no particular limitation on the molecular weight of polyethylene. However, it is preferred that the melt index is within 1.0 g/10 minutes to 40 g/10 minutes for both high density polyethylene and low density polyethylene, and is preferred that it has extrusion suitability.

In addition, a treatment may be performed to confer white reflective properties on these sheets or films. An example of such a treatment method is to blend a pigment such as titanium oxide or the like into these sheets or films.

The resin used for coating or laminating is not limited to a thermoplastic resin. Examples of the resins for coating or laminating further include resin in which monomer or thermoplastic resin is reacted with light, hardeners, cross-linking agents, or the like, thermocuring resin, and the like.

At least one layer of the aforesaid coating or laminated resin layers may be a monomer containing a photopolymerization initiator, or may be a resin composition cured by UV irradiation. The resin composition may in this case contain an electron beam-hardening organic compound as a main component. There is no particular limitation on the type of this electron-beam hardening organic compound, which may be a monomer or an oligomer. These may be used either alone or in combination of two or more.

The aforesaid electron-beam hardening unsaturated compound may for example be selected from the following compounds.

(1) Acrylate compounds of aliphatic, alicyclic or aromatic-aliphatic monovalent to sixvalent alcohols and polyalkylene glycols (2) Acrylate compounds obtained by adding alkylene oxides to aliphatic, alicyclic or aromatic-aliphatic monovalent to sixvalent alcohols (3) Polyacryloylalkyl phosphate esters (4) Reaction products of carboxylic acids, polyols, and acrylic acid (5) Reaction products of isocyanates, polyols, and acrylic acid (6) Reaction products of epoxy compounds and acrylic acid (7) Reaction products of epoxy compounds, polyols, and acrylic acid Examples of these compounds, or specifically, examples of the electron-beam hardening unsaturated organic compound, include polyoxyethylene epichlorohydrin-modified bisphenol A diacrylate, dicyclohexyl acrylate, epichlorohydrin-modified polyethylene glycol diacrylate, 1,6-hexanediol diacrylate, hydroxybivaric acid ester neopentyl glycol diacrylate, nonyl phenoxypolyethylene glycol acrylate, ethylene oxide-modified phenoxyic phosphoric acid acrylate, ethylene oxide-modified phthalic acid acrylate, polybutadiene acrylate, caprolactam-modified tetrahydrofurfuryl acrylate, tris(acryloxyethyl) isocyanate, trimethylol-propane triacrylate, pentaerythritol triacrylate, pentaerythritol tetraacrylate, pentaerythritol penta-acrylate, dipentaerythritol hexaacrylate, polyethylene glycol diacrylate, 1,4-butadiene diol diacrylate, neopentyl glycol diacrylate, neo pentyl glycol-modified trimethylol-propane diacrylate, and the like.

According to the present invention, these organic compounds may be used either alone or in combination of two or more.

Regarding the aforesaid coating or laminated resin layer, there is no particular limitation on the type of UV radiation hardening organic compound which becomes cured by UV irradiation. This UV radiation hardening resin composition may be prepared by adding a suitable amount of the aforesaid photopolymerization initiator to the aforesaid electron-beam hardening resin. According to the present invention, the resin composition used for electron-beam hardening may or may not contain a photopolymerization initiator, and it is preferable to use it to the extent that it does not generate an odor.

The photopolymerization initiator may be any of those known in the art. Example of the photopolymerization initiator include ethyl anthraquinone, methyl benzoyl formate, 1-hydroxycyclohexyl phenylketone, antophenone, acetophenones such as diethoxyacetophenone, and trichloroacetophenone, o-benzoyl methylbenzoate, benzophenone, Michler's ketone, benzyl, benzoin, benzoin alkyl ether, benzyl dimethylketal, tetramethyl thiuram monosulfide, xanthone, thioxanthones, benzophenones, azo compounds, and the like. These photopolymerization initiators may be used either alone, or combination of two or more.

The amount to add the aforesaid photopolymerization initiator is preferably 0.1% by mass to 10% by mass relative to the mass of UV radiation hardening resin. The concurrent use of photopolymerization promoters known in the art such as N-methyldiethanolamine, bis-diethyl aminobenzophenone, or the like together with the aforesaid photopolymerization initiator is preferred to improve the curing rate. There is no particular limitation on the amount to add the aforesaid photopolymerization promoter as long as it has an effect. However, it is generally preferred to be 0.5 times to 2 times more than the mass of photopolymerization initiator.

There is no particular limitation on the electron-beam accelerator used for the aforesaid electron beam irradiation. Example of the electron-beam accelerator include the electron beam irradiation device such as a Van der Graaf scanning type, a double scanning type, a curtain beam type, or the like.

There is no particular limitation on the ultraviolet irradiation device used for the aforesaid UV irradiation. Examples of the ultraviolet irradiation device include a low-pressure mercury lamp, medium pressure mercury lamp, high-pressure mercury lamp, metal halide lamp, and the like.

The aforesaid support may have a desired laminated constitution of the various kinds of support mentioned above.

Methods for coating resin or like on the raw paper or the like include coating, impregnating, or spraying a resin solution or suspension onto the raw paper.

To improve adhesion of the resin to be coated on the raw paper, it is preferred to give one or both surfaces of the raw paper an activation treatment, such as corona discharge treatment, flame treatment, glow discharge treatment or the like, or plasma treatment, prior to coating or laminating the resin.

A surface treatment such as corona discharge treatment may be given to the raw paper, the synthetic paper or synthetic resin sheet, or after providing a coating layer or laminated layer thereon, or an undercoat may be applied to the surface, to improve the adhesion of the upper layer, for example, the toner image-receiving layer.

In addition, the surface of the thermoplastic resin layer used for the coated paper may, if necessary, be given a gloss finish, or a fine finish, matt finish or grainy finish as described in JP-A No. 55-26507, or a non-gloss finish may if necessary be given to the surface of the thermoplastic resin layer on the opposite side (undersurface) to the side on which the electroconducting layer is provided. Further, activation such as corona discharge treatment or flame treatment can be applied to these surfaces after giving them a finish. These treatments may be carried out either alone, or in a desirable combination of two ore more treatments. The desirable combination includes subjecting the surface of the layer to activation after shaping or the like, providing under-coating after the activation, and the like.

Suitable additives may be added to the thermal plastic resin layer or the like, as long as it does not affect the objects of the present invention.

The thickness of the aforesaid support is preferably 25 μm to 300 μm, more preferably 50 μm to 260 μm, and still more preferably 75 μm to 220 μm. Supports having various rigidity may be used according to the purpose. It is preferred that the support used for electrophotographic image-receiving sheets of photographic image quality is close to the support used for color film photos.

From the viewpoint of fixing performance, it is preferred that the thermal conductivity of the support under the condition of 65% of relative humidity at 20° C. is, for example, 0.50 kcal/m·h·° C., or more. Here, thermal conductivity can be measured on a humidified transfer supported on JIS P 8111 by the process disclosed in JP-A No. 53-66279. It is also preferred from the above viewpoint, that the density of this support is 0.7 g/cm$^3$ or more.

Various kinds of additives, suitably selected as long as it does not adversely affect the objects of the present invention, can be blended into the support. Examples of the additives include whiteners, conductive agents, fillers, titanium oxide, ultramarine blue, pigments such as carbon black, or the like.

Hydrophilic binders, alumina sol, semiconducting metal oxides such as tin oxide, and carbon black or other antistatic agents may be blended with the support, or coated on its surface or undersurface, or both. Specifically, the support disclosed in JP-A No. 63-220246 may be used. It is preferred that this support can withstand the fixing temperature, and can satisfy requirements regarding whiteness degree, slipping properties, frictional properties, antistatic properties, depression after fixing, and the like.

<Layer Which Forms a Surface of an Image-receiving Sheet>

The surface of the image-receiving sheet on the toner image-receiving layer side of the support, refers to the surface of the image-receiving sheet in contact with the fixing belt. Specific examples of the surface of the image-receiving sheet include the toner image-receiving layer and surface protection layer on the support, both of which are layers on the surface of the image-receiving sheet. For example, this may be the toner image-receiving layer (2) in FIG. 3.

<Toner Image-receiving Layer>

If there is a toner image-receiving layer on the surface of the image-receiving sheet, the layer which forms the surface of the image-receiving sheet is the toner image-receiving layer. The toner image-receiving layer comprises a polymer, and preferably comprises a thermoplastic resin as its main component. The amount of the polymer contained in the toner image-receiving layer is 10% by mass or more, and preferably 30% by mass or more, relative to the mass of the toner image-receiving layer. The amount of the polymer is still more preferably 90% by mass to 99.5% by mass, and further still more preferably 93% by mass to 99% by mass, relative to the mass of the toner image-receiving layer.

The toner image-receiving layer is provided on or above at least one side of the support, and has functions to receive toner which forms an image from a developing drum or intermediate transfer body due to (static) electricity or pressure, or the like. in a transfer step, and be fixed by heat or pressure, or the like, in a belt fixing step.

To give the toner image-receiving layer of the present invention a photographic texture, it has a low light transmittance of preferably 78% or less, more preferably 73% or less and still more preferably 72% or less.

The light transmittance can be measured by separately forming a coating film having the same thickness on a polyethylene terephthalate film (100 μm), using a direct-reading haze meter (Suga Test Instruments HGM-2DP) on the coating film.

The material of the above-mentioned toner image-receiving layer includes at least a thermoplastic resin and a releasing agent. Other materials may be also contained, if needed.

—Thermoplastic Resin—

There is no particular limitation on the above-mentioned thermoplastic resin which may be selected according to the purpose, as long as it can change its shape at the fixing temperature and can receive toner. It is preferable if the thermoplastic resin is similar to the binder resin of the toner. Many of the toners contain polyester resin, styrene or a copolymer resin such as styrene-butylacrylate. In this case, it is preferable to use a polyester resin, styrene or a copolymer resin such as styrene-butylacrylate as the thermoplastic resin used for the electrophotographic image-receiving sheet. It is more preferable to use 20% by mass or more of the polyester resin, styrene or copolymer resin such as styrene-butylacrylate. Styrene, styrene-butylacrylate copolymer, styrene-acrylic acid ester copolymer and styrene-methacrylic acid ester copolymer are also preferred.

Specific examples of the thermoplastic resin include (a) resins containing ester bonds, (b) polyurethane resins, (c) polyamide resins, (d) polysulfone resins, (e) polyvinyl chloride resins, (f) polyvinyl butyral, (g) polycaprolactone resins, (h) polyolefin resins, and the like.

Examples of (a) resins containing ester bonds include polyester resins obtained by condensation of a dicarboxylic acid component, such as terephthalic acid, isophthalic acid, maleic acid, fumaric acid, phthalic acid, adipic acid, sebacic acid, azelaic acid, abietic acid, succinic acid, trimellitic acid, pyromellitic acid, or the like (in these dicarboxylic acid components, the sulfonic acid group, carboxyl group, or the like may be substituted), with an alcohol component such as ethylene glycol, diethylene glycol, propylene glycol, bisphenol A, diether derivative of bisphenol A (for example, ethyleneoxide biaddition product of bisphenol A, propylene oxide biaddition product of bisphenol A, or the like), bisphenol S, 2-ethyl cyclohexyl dimethanol, neopentyl glycol, cyclohexyldimethanol, glycerol, or the like (in these alcohol components, the hydroxyl group may be substituted), polyacrylic ester resins or polymethacrylic acid ester resins, such as polymethylmethacrylate, polbutylmethacrylate, polymethyl acrylate and polybutylacrylate, polycarbonate resins, polyvinyl acetate resins, styrene acrylate resins, styrene-methacrylic acid ester copolymer resin, vinyltoluene acrylate resin, and the like.

Specific examples are given in Japanese Patent Application Laid-Open (JP-A) Nos. 59-101395, 63-7971, 63-7972, 63-7973 and 60-294862, or the like.

Commercially available products of the above-mentioned polyester resins are Bylon 290, Bylon 200, Bylon 280, Bylon 300, Bylon 103, Bylon GK-140 and Bylon GK-130 from Toyobo Co., Ltd; Tufton NE-382, Tufton U-5, ATR-2009 and ATR-2010 from Kao Corporation; Eritel UE3500, UE3210 and XA-8153 from Unitika Ltd; Polyester TP-220, R-188 from The Nippon Synthetic Chemical Industry Co., Ltd, or the like.

Commercially available products of the above-mentioned acrylic resins are SE-5437, SE-5102, SE-5377, SE-5649, SE-5466, SE-5482, HR-169, 124, HR-1127, HR-116, HR-113, HR-148, HR-131, HR-470, HR-634, HR-606, HR-607, LR-1065, 574, 143, 396, 637, 162, 469, 216, BR-50, BR-52, BR-60, BR-64, BR-73, BR-75, BR-77, BR-79, BR-80, BR-83, BR-85, BR-87, BR-88, BR-90, BR-93, BR-95, BR-100, BR-101, BR-102, BR-105, BR-106, BR-107, BR-108, BR-112, BR-113, BR-115, BR-116, BR-117 from Mitsubishi Rayon Ltd.; Esrec P SE-0020, SE-0040, SE-0070, SE-0100, SE-1010, SE-1035 from Sekisui Chemical Co., Ltd.; Himer ST95 and ST120 from Sanyo Chemical Industries, Ltd.; FM601 from Mitsui Chemicals, Inc, or the like.

The polyvinyl chloride resin (e) mentioned above may, for example, be a polyvinylidene chloride resin, vinyl chloride-vinyl acetate copolymer resin, vinyl chloride-propionic acid vinyl copolymer resin, or the like.

The polyvinyl butyral (f) mentioned above may be a cellulose resin such as a polyol resin, ethyl cellulose resin, cellulose acetate resin, or the like. Commercially available products thereof are manufactured by Denki Kagaku Kogyo Kabushiki Kaisha and Sekisui Chemicals Ltd. The aforesaid polyvinyl butyral preferably contains 70% by mass or more of polyvinyl butyral, and preferably has an average polymerization degree of 500 or more, and more preferably an average polymerization degree of 1000 or more. Commercially available products thereof are Denka Butyral 3000-1, 4000-2, 5000A and 6000C from Denki Kagaku Kogyo Kabushiki Kaisha; and Esrec BL-1, BL-2, BL-3, BL-S, BX-L, BM-1, BM-2, BM-5, BM-S, BH-3, BX-1, BX-7 from Sekisui Chemicals Ltd, or the like.

Further, examples of the polycaprolactone resin (g) include styrene-maleic anhydride resin, polyacrylonitrile resin, polyether resins, epoxy resins, phenol resins, and the like.

Examples of the polyolefin resin (h) include polyethylene resin and polypropylene resin, copolymer resins of olefins such as ethylene, propylene, or the like with other vinyl monomers; acrylic resins, and the like.

These thermoplastic resins can be used either alone or in combination of two or more. Additionally, mixtures thereof and copolymers thereof can also be used.

It is preferred that the thermoplastic resin satisfies the physical properties of the toner image-receiving layer when the toner image-receiving sheet is formed. It is more preferred that it satisfies the physical properties of the toner image-receiving layer when the resin is used alone. It is also preferred that two or more resins giving different physical properties to the toner image-receiving layer are used in combination.

It is preferred that the thermoplastic resin has a larger molecular weight than that of the thermoplastic resin used for the toner. However, this molecular weight relation may not always be desirable depending on the thermodynamic properties of the thermoplastic resin used for the toner and the resin used for the toner image-receiving layer. For example, if the softening temperature of the resin used for the toner image-receiving layer is higher than that of the thermoplastic resin used for the toner, it is preferred that the molecular weights are identical, or that the molecular weight of the resin used for the toner image-receiving layer is smaller.

It is preferred that the thermoplastic resin used is a mixture of resins with identical compositions having different average molecular weights. The relation of molecular weights of thermoplastic resins used as toners is disclosed in JP-A No. 08-334915.

The molecular weight distribution of the thermoplastic resin is preferably wider than the molecular weight distribution of the thermoplastic resin used in the toner.

It is preferred that the thermoplastic resin satisfies the physical properties disclosed in Japanese Patent Application Publication (JP-B) No. 05-127413, JP-A Nos. 08-194394, 08-334915, 08-334916, 09-171265, 10-221877, and the like.

Due to the reasons (i) to (ii) below, it is particularly preferred that the thermoplastic resin used in the toner image-receiving layer is an aqueous resin such as a water-soluble resin or water-dispersible resin.

(i) there is no discharge of organic solvent in the coating and drying steps, which is excellent for the environment and provides easy working.

(ii) many releasing agents such as wax are difficult to soluble in solvents at room temperature, so the releasing agents are often dispersed in a solvent (water, organic solvent) in advance. If they are dispersed in water, they are stable and highly suited to manufacturing steps. Further, if they are applied in an aqueous form, the wax easily bleeds on the surface in the coating and drying steps, and it is easy to obtain a releasing agent effect (offset-resistance, adhesion-resistance, and the like).

As long as it is a water-soluble resin or water-degradable resin, the aqueous resin may have any composition, bond structure, molecular structure, molecular weight, molecular weight distribution or formation.

Examples of polymer groups which confer aqueous affinity include a sulfonyl group, a hydroxyl group, a carboxyl group, an amino group, an amide group, an ether group, and the like.

Examples of the aforesaid water-soluble resins are given on page 26 of *Research Disclosure* No. 17,643, page 651 of *Research Disclosure* No. 18,716, pp 873-874 of *Research Disclosure* Nos. 307,105 and pp 71-75 of JP-A No. 64-13546.

Specific examples include a vinyl pyrrolidone-vinyl acetate copolymer, styrene-vinyl pyrrolidone copolymer, styrene-maleic anhydride copolymer, water-soluble polyester, water-soluble acryl, water-soluble polyurethane, water-soluble nylon, a water-soluble epoxy resin, and the like. Moreover, various types of gelatins may be selected according to the purpose from liming gelatin, acid-treated gelatin and deliming gelatin wherein the content of calcium, or the like, is reduced, and it is also preferable to use these in combination. Examples of water-soluble polyesters are various plus coats from GaO Chemical Industries and the FineTex ES series from Dainippon Ink and Chemicals, Incorporated. Examples of water-soluble acryls are the Julimer AT series from NIHON JUNYAKU CO., LTD., FineTex 6161 and K-96 from Dainippon Ink and Chemicals, Incorporated, and High Loss NL-1189 and BH-997L from SEIKO CHEMICAL INDUSTRIES CO., LTD.

Examples of water dispersible resins are water-dispersible type resins such as water-dispersible acrylate resin, water-dispersible polyester resin, water-dispersible polystyrene resin, water-dispersible urethane resin, or the like; and emulsions such as acrylic resin emulsion, polyvinyl acetate emulsion, SBR (styrene butadiene) emulsion, or the like. The resin can be conveniently selected from an aqueous dispersion of the aforesaid thermoplastic resins (a) to (h), their emulsions, or their copolymers, mixtures and cation-modified, or the like. Two or more of these sorts can be combined.

Examples of the aforesaid water-dispersible resins in the polyester class are the Byronal Series from Toyobo Co., Ltd, the Pethregin A Series from TAKAMATSU OIL&FAT CO., LTD, the Tufton UE Series from Kao Corporation, the Japan Synthetic Polyester WR Series, the Aeriel Series from Unitika Ltd., and the like. Examples in the acrylic class include the High Loss XE, KE and PE series from SEIKO CHEMICAL INDUSTRIES CO., LTD., the Julimer ET series from NIHON JUNYAKU CO., LTD., and the like.

It is preferred that the film-forming temperature (MFT) of the polymer is above room temperature for storage before printing, and is 100° C. or lower for fixing of toner particles.

In the present invention, it is preferable to use a self-dispersing aqueous polyester resin emulsion which satisfies the following characteristics (1) to (4) as the above-mentioned thermoplastic resin. As the thermoplastic resin is a self-dispersing type which does not use a surfactant, its hygroscopic properties are low even in a high humidity environment, its softening point is not much lowered by moisture, and offset produced during fixing, or sticking of sheets in storage, can be prevented. Moreover, since it is aqueous, it is excellent in terms of environment and of workability. As it uses a polyester resin which assumes a molecular structure with high cohesion energy, it has sufficient hardness in a storage environment, assumes a melting state of low elasticity (low viscosity) in the electrophotographic fixing step, and toner is embedded in the image-receiving layer so as to attain image quality.

(1) The number average molecular weight (Mn) is preferably 5000 to 10000, and more preferably 5000 to 7000.

(2) The molecular weight distribution (weight average molecular weight/number average molecular weight) is preferably $\leqq 4$, and Mw/Mn is more preferably $\leqq 3$.

(3) The glass transition temperature (Tg) is preferably 40° C. to 100° C., and more preferably 50° C. to 80° C.

(4) The volume average particle diameter is preferably 20 nmϕ to 200 nmϕ, and more preferably 40 nmϕ to 150 nmϕ.

—Releasing Agent—

The releasing agent of the present invention is blended into the toner image-receiving layer, in order to prevent offset of the toner image-receiving layer. There is no particular limitation on the type of releasing agent of the present invention, as long as it dissolves, deposits onto the surface of the toner image-receiving layer, and is unevenly disposed on the surface of the toner image-receiving layer when heated to the fixing temperature, and forms a layer of releasing agent in the surface of the toner image-receiving layer when cooled and solidified.

The releasing agent having such effects is one or more type of releasing agents selected from a silicone compound, a fluorine compound, wax, and a matting agent. Preferably, the releasing agent is one or more types selected from silicone oil, polyethylene wax, carnauva wax, silicone particles and polyethylene wax particles.

The releasing agent used in the present invention may for example be a compound mentioned in "Properties and Applications of Waxes (Revised)" published by Saiwai Shobo, or in "The Silicone Handbook" published by THE NIKKAN KOGYO SHIMBUN. Also, the silicone compounds, fluorine compounds and wax used in the toners mentioned in Japanese Patent Application Publication (JP-B) No. 59-38581, Japanese Patent Application Publication (JP-B) No. 04-32380, Japanese Patent (JP-B) No. 2838498, No. 2949558, Japanese Patent Application Laid-Open (JP-A) No. 50-117433, 52-52640, 57-148755, 61-62056, 61-62057, 61-118760, and Japanese Patent Application Laid-Open (JP-A) No. 02-42451, 03-41465, 04-212175, 04-214570, 04-263267, 05-34966, 05-119514, 06-59502, 06-161150, 06-175396, 06-219040, 06-230600, 06-295093, 07-36210, 07-43940, 07-56387, 07-56390, 07-64335, 07-199681, 07-223362, 07-287413, 08-184992, 08-227180, 08-248671, 08-248799, 08-248801, 08-278663, 09-152739, 09-160278, 09-185181, 09-319139, 09-319143, 10-20549, 10-48889, 10-198069, 10-207116, 11-2917, 11-44969, 11-65156, 11-73049 and 11-194542 may be used. These compounds can be used also in combination of two or more.

Examples of silicone compounds include non-modified silicone oils (specifically, dimethyl siloxane oil, methyl hydrogen silicone oil, phenyl methyl-silicone oil, or commercial products such as KF-96, KF-96L, KF-96H, KF-99, KF-50, KF-54, KF-56, KF-965, KF-968, KF-994, KF-995 and HIVAC F-4, F-5 from Shin-Etsu Chemical Co., Ltd.; SH200, SH203, SH490, SH510, SH550, SH710, SH704, SH705, SH7028A, SH7036, SM7060, SM7001, SM7706, SH7036, SH8710, SH1107 and SH8627 from Dow Corning Toray Silicone Co., Ltd.; and TSF400, TSF401, TSF404, TSF405, TSF431, TSF433, TSF434, TSF437, TSF450 Series, TSF451 series, TSF456, TSF458 Series, TSF483, TSF484, TSF4045, TSF4300, TSF4600, YF33 Series, YF-3057, YF-3800, YF-3802, YF-3804, YF-3807, YF-3897, XF-3905, XS69-A1753, TEX100, TEX101, TEX102, TEX103, TEX104, TSW831, and the like from GE Toshiba Silicones), amino-modified silicone oils (for example, KF-857, KF-858, KF-859, KF-861, KF-864 and KF-880 from Shin-Etsu Chemical Co., Ltd., SF8417 and SM8709 from Dow Corning Toray Silicone Co., Ltd., and TSF4700, TSF4701, TSF4702, TSF4703, TSF4704, TSF4705, TSF4706, TEX150, TEX151 and TEX154 from GE Toshiba Silicones), carboxy-modified silicone oils (for example, BY16-880 from Dow Corning Toray Silicone Co., Ltd., TSF4770 and XF42-A9248 from GE Toshiba Silicones), carbinol-modified silicone oils (for example, XF42-B0970 from GE Toshiba Silicones), vinyl-modified silicone oils (for example, XF40-A1987 from GE Toshiba Silicones), epoxy-modified silicone oils (for example, SF8411 and SF8413 from Dow Corning Toray Silicone Co., Ltd.; TSF3965, TSF4730, TSF4732, XF42-A4439, XF42-A4438, XF42-A5041, XC96-A4462, XC96-A4463, XC96-A4464 and TEX170 from GE Toshiba Silicones), polyether-modified silicone oils (for example, KF-351 (A), KF-352 (A), KF-353 (A), KF-354 (A), KF-355 (A), KF-615(A), KF-618 and KF-945 (A) from Shin-Etsu Chemical Co., Ltd.; SH3746, SH3771, SF8421, SF8419, SH8400 and SF8410 from Dow Corning Toray Silicone Co., Ltd.; TSF4440, TSF4441, TSF4445, TSF4446, TSF4450, TSF4452, TSF4453 and TSF4460 from GE Toshiba Silicones), silanol-modified silicone oils, methacryl-modified silicone oils, mercapto-modified silicone oils, alcohol-modified silicone oils (for example, SF8427 and SF8428 from Dow Corning Toray Silicone Co., Ltd., TSF4750, TSF4751 and XF42-B0970 from GE Toshiba Silicones), alkyl-modified silicone oils (for example, SF8416 from Dow Corning Toray Silicone Co., Ltd., TSF410, TSF411, TSF4420, TSF4421, TSF4422, TSF4450, XF42-334, XF42-A3160 and XF42-A3161 from GE Toshiba Silicones), fluorine-modified silicone oils (for example, FS1265 from Dow Corning Toray Silicone Co., Ltd., and FQF501 from GE Toshiba Silicones), silicone rubbers and silicone fine particles (for example, SH851, SH745U, SH55UA, SE4705U, SH502 UA&B, SRX539U, SE6770 U-P, DY 38-038, DY38-047, Trefil F-201, F-202, F-250, R-900, R-902A, E-500, E-600, E-601, E-506, BY29-119 from Dow Corning Toray Silicone Co., Ltd.; Tospal 105, 120, 130, 145, 240 and 3120 from GE Toshiba Silicones), silicone-modified resins (specifically, olefin resins or polyester resins, vinyl resins, polyamide resins, cellulosic resins, phenoxy resins, vinyl chloride-vinyl acetate resins, urethane resins, acrylic resins, styrene-acrylic resins, compounds in which copolymerization resins thereof are modified by silicone, for example, Diaroma SP203V, SP712, SP2105 and SP3023 from Dainichiseika Color & Chemicals Mfg. Co., Ltd.; Modepa FS700, FS710, FS720, FS730 and FS770 from NOF CORPORATION; Simac US-270, US-350, US-352, US-380, US-413, US-450, Reseda GP-705, GS-30, GF-150 and GF-300 from TOAGOSEI CO. LTD.; SH997, SR2114, SH2104, SR2115, SR2202, DCI-2577, SR2317, SE4001U, SRX625B, SRX643, SRX439U, SRX488U, SH804, SH840, SR2107 and SR2115 from Dow Corning Toray Silicone Co., Ltd., YR3370, TSR1122, TSR102, TSR108, TSR116, TSR117, TSR125A, TSR127B, TSR144, TSR180, TSR187, YR47, YR3187, YR3224, YR3232, YR3270, YR3286, YR3340, YR3365, TEX152, TEX153, TEX171 and TEX172 from GE Toshiba Silicones), and reactive silicone compounds (specifically, addition reaction type, peroxide-curing type and ultraviolet radiation curing type, examples include: TSR1500, TSR1510, TSR1511, TSR1515, TSR1520, YR3286, YR3340, PSA6574, TPR6500, TPR6501, TPR6600, TPR6702, TPR6604, TPR6700, TPR6701, TPR6705, TPR6707, TPR6708, TPR6710, TPR6712, TPR6721, TPR6722, UV9300, UV9315, UV9425, UV9430, XS56-A2775, XS56-A2982, XS56-A3075, XS56-A3969, XS56-A5730, XS56-A8012, XS56-B1794, SL6100, SM3000, SM3030, SM3200 and YSR3022 from GE Toshiba Silicones), and the like.

Examples of fluorine compounds include fluorine oils (for example, Daifluoryl #1, # 3, #10, #20, #50, #100, Unidyne TG-440, TG-452, TG-490, TG-560, TG-561, TG-590, TG-652, TG-670U, TG-991, TG-999, TG-3010, T Ltd.; MF-100, MF-110, MF-120, MF-130, MF-160 and MF-160E from Tohkem Products; S-111, S-112, S-113, S-121, S-131, S-132, S-141 and S-145 from Asahi Glass Co., Ltd.; and, FC-430 and FC-431 from DU PONT-MITSUI FLUORO-CHEMICALS COMPANY, LTD), fluoro rubbers (for example, LS63U from Dow Corning Toray Silicone Co., Ltd.), fluorine-modified resins (for example, Modepa F200, F220, F600, F2020, F600, F2020, F3035 from Nippon Oils and Fats; Diaroma FF203 and FF204 from Dai Nichi Pure Chemicals; Saflon S-381, S-383, S-393, SC-101, SC-105, KH-40 and SA-100 from Asahi Glass Co., Ltd.; EF-351, EF-352, EF-801, EF-802, EF-601, TFE, TFEA, TFEMA and PDFOH from Tohkem Products; and THV-200P from Sumitomo 3M), fluorine sulfonic acid compound (for example, EF-101, EF-102, EF-103, EF-104, EF-105, EF-112, EF-121, EF-122A, EF-122B, EF-122C, EF-123A, EF-123B, EF-125M, EF-132, EF-135M, EF-305, FBSA, KFBS and LFBS from Tohkem Products), fluorosulfonic acid, and fluorine acid compounds or salts (specifically, anhydrous fluoric acid, dilute fluoric acid, fluoroboric acid, zinc fluoroborate, nickel fluoroborate, tin fluoroborate, lead fluoroborate, copper fluoroborate, fluorosilicic acid, fluorinated potassium titanate, perfluorocaprylic acid, ammonium perfluorooctanoate, and the like), inorganic fluorides (specifically, aluminum fluoride, potassium fluoride, fluorinated potassium zirconate, fluorinated zinc tetrahydrate, calcium fluoride, lithium fluoride, barium fluoride, tin fluoride, potassium fluoride, acid potassium fluoride, magnesium fluoride, fluorinated titanic acid, fluorinated zirconic acid, ammonium hexafluorinated phosphoric acid, potassium hexafluorinated phosphoric acid, and the like).

Examples of the wax include synthetic hydrocarbon, modified wax, hydrogenated wax, natural wax, and the like.

Examples of the synthetic hydrocarbon include polyethylene wax (for example, polyron A, 393, and H-481 from Chukyo Yushi Co., Ltd.; Sunwax E-310, E-330, E-250P, LEL-250, LEL-800, LEL-400P, from SANYO KASEI Co., Ltd.), polypropyrene wax (for example, biscoal 330-P, 550-P, 660-P from SANYO KASEI Co., Ltd.), Fischer toropush wax (for example, FT100, and FT-0070, from Nippon Seiro Co., Ltd.), an acid amide compound or an acid imide compound (specifically, stearic acid amide, anhydrous phthalic acid imide, or the like; for example, Cellusol 920, B-495, hymicron G-270, G-110, hydrine D-757 from Chukyo Yushi Co., Ltd.), and the like.

Examples of the modified wax include amine-modified polypropyrene (for example, QN-7700 from SANYO KASEI Co., Ltd.), acryl-modified wax, fluorine-modified wax, olefin-modified wax, urethan wax (for example, NPS-6010, and HAD-5090 from Nippon Seiro Co., Ltd.), alcohol wax (for example, NPS-9210, NPS-9215, OX-1949, XO-020T from Nippon Seiro Co., Ltd.), and the like.

Examples of hydrogenated waxes include cured castor oil (for example, castor wax from Itoh Oil Chemicals Co., Ltd.), castor oil derivatives (for example, dehydrated castor oil DCO, DCO Z-1, DCO Z-3, castor oil aliphatic acid CO-FA, ricinoleic acid, dehydrated castor oil aliphatic acid DCO-FA, dehydrated castor oil aliphatic acid epoxy ester D-4 ester, castor oil urethane acrylate CA-10, CA-20, CA-30, castor oil derivative MINERASOL S-74, S-80, S-203, S-42×, S-321, special castor oil condensation aliphatic acid MINERASOL RC-2, RC-17, RC-55, RC-335, special castor oil condensation aliphatic acid ester MINERASOL LB-601, LB-603, LB-604, LB-702, LB-703, #11 and L-164 from Itoh Oil Chemicals Co., Ltd.), stearic acid (for example, 12-hydroxystearic acid from Itoh Oil Chemicals Co., Ltd.), lauric acid, myristic acid, palmitic acid, behenic acid, sebacic acid (for example, sebacic acid from Itoh Oil Chemicals Co., Ltd.), undecylenic acid (for example, undecylenic acid from Itoh Oil Chemicals Co., Ltd.), heptyl acids (heptyl acids from Itoh Oil Chemicals Co., Ltd.), maleic acid, high grade maleic oils (for example, HIMALEIN DC-15, LN-10, 00-15, DF-20 and SF-20 from Itoh Oil Chemicals Co., Ltd.), blown oils (e.g., selbonol #10, #30, #60, R-40 and S-7 from Itoh Oil Chemicals Co., Ltd.) and synthetic waxes such as cyclopentadieneic oil (CP oil and CP oil-S from Itoh Oil Chemicals Co., Ltd.).

The natural wax is preferably selected at least from vegetable wax, mineral wax, and petroleum wax. Of these, vegetable wax is more preferable. A preferable example of the mineral wax includes water-dispersed wax, from a viewpoint of compatibility with solution, when a hydrogetic thermal curing resin is used as the thermal curing resin in an image-receiving layer of the toner.

Examples of the vegetable wax include carnuba waxes (for example, EMUSTAR AR-0413 from Nippon Seiro Co., Ltd., and Cellusol 524 from Chukyo Yushi Co., Ltd.), castor oil (purified castor oil from Itoh Oil Chemicals Co., Ltd.), rapeseed oil, soybean oil, Japan tallow, cotton wax, rice wax, sugarcane wax, candellila wax, Japan wax, jojoba oil, and the like.

Examples of animal waxes are bees wax, lanolin, spermaceti, whale oil, wool wax, and the like. Of those, carnuba wax having a melting point of 70° C. to 95° C. is particularly preferable from viewpoints of providing a fixing belt type electrophotographic image receiving sheet which is excellent in offset-resistance, adhesive resistance, transfer properties, brilliance, is less likely to cause cracking and splitting, and is capable of forming a high quality image.

Examples of the mineral wax include natural waxes such as montan wax, montan ester wax, ozokerite, ceresin, and the like; aliphatic acid esters (Sansosizer-DOA, AN-800, DINA, DIDA, DOZ, DOS, TOTM, TITM, E-PS, NE-PS, E-PO, E-4030, E-6000, E-2000H, E-9000H, TCP, C-1100, and the like, from New Japan Chemical Co., Ltd.), and the like. Of these, montan wax having a melting point of 70° C. to 95° C. is particularly preferable from viewpoints of providing a fixing belt type electrophotographic image receiving sheet which is excellent in offset-resistance, adhesive resistance, transfer properties, brilliance, is less likely to cause cracking and splitting, and is capable of forming a high quality image.

Examples of the petroleum wax include a paraffin wax (for example, Paraffin wax 155, 150, 140, 135, 130, 125, 120, 115, HNP-3, HNP-5, HNP-9, HNP-10, HNP-11, HNP-12, HNP-14G, SP-0160, SP-0145, SP-1040, SP-1035, SP-3040, SP-3035, NPS-8070, NPS-L-70, OX-2151, OX-2251, EMUSTAR-0384 and EMUSTAR-0136 from Nippon Seiro Co., Ltd.; Cellosol 686, 428, 651-A, A, H-803, B-460, E-172, 866, K-133, hydrin D-337 and E-139 from Chukyo Yushi Co., Ltd.; 125° paraffin, 125° FD, 130° paraffin, 135° paraffin, 135° H, 140° paraffin, 140° N, 145° paraffin and paraffin wax M from Nippon Oil Corporation), or a microcrystalline wax (for example, Hi-Mic-2095, Hi-Mic-3090, Hi-Mic-1080, Hi-Mic-1070, Hi-Mic-2065, Hi-Mic-1045, Hi-Mic-2045, EMUSTAR-0001 and EMUSTAR-042× from Nippon Seiro Co., Ltd.; Cellosol 967, M, from Chukyo Yushi Co., Ltd.; 155 Microwax and 180 Microwax from Nippon Oil Corporation), and petrolatum (for example, OX-1749, OX-0450, OX-0650B, OX-0153, OX-261BN, OX-0851, OX-0550, OX-0750B, JP-1500, JP-056R and JP-011P from Nippon Seiro Co., Ltd.), and the like.

A content of the natural wax in the toner receiving layer (a surface) is preferably 0.1 g/m$^2$ to 4 g/m$^2$, and more preferably 0.2 g/m$^2$ to 2 g/m$^2$. If the content is less than 0.1 g/m$^2$, the offset-resistance and the adhesive resistance deteriorate. If the content is more than 4 g/m$^2$, the quality of an image may deteriorate because of the excessive amount of wax.

The melting point of the natural wax is preferably 70° C. to 95° C., and more preferably 75° C. to 90° C., from a viewpoint of offset-resistance and paper transfer properties.

The matting agent can be selected from any known matting agent. Solid particles used as matting agents can be classified into inorganic particles and organic particles. Specifically, the inorganic matting agents may be oxides (for example, silicon dioxide, titanium oxide, magnesium oxide, aluminum oxide), alkaline earth metal salts (for example, barium sulfate, calcium carbonate, and magnesium sulfate), silver halides (for example, silver chloride, and silver bromide), glass, and the like.

Examples of inorganic matting agents can be found, for example, in West German Patent No. 2529321, UK Patents Nos. 760775, 1260772, and U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504.

Materials of the aforesaid organic matting agent include starch, cellulose ester (for example, cellulose-acetate propionate), cellulose ether (for example, ethyl cellulose) and a synthetic resin. It is preferred that the synthetic resin is insoluble or had to become solved. Examples of insoluble or hard to become solved in synthetic resins include poly(meta) acrylic acid esters (for example, polyalkyl(meta)acrylate, polyalkoxyalkyl(meta)acrylate, polyglycidyl(meta)acrylate), poly(meta) acrylamide, polyvinyl ester (for example, polyvinyl acetate), polyacrylonitrile, polyolefins (for example, polyethylene), polystyrene, benzoguanamine resin, formaldehyde condensation polymer, epoxy resin, polyamide, polycarbonate, phenolic resin, polyvinyl carbazole and polyvinylidene chloride.

Copolymers which combine the monomers used in the above polymers, may also be used.

In the case of the aforesaid copolymers, a small amount of hydrophilic repeating units may be included. Examples of monomers which form a hydrophilic repeated unit include acrylic acid, methacrylic acid, α,β-unsaturated dicarboxylic acid, hydroxyalkyl(meta)acrylate, sulfoalkyl (meta)acrylate and styrene sulfonic acid.

Examples of organic matting agents can be found, for example, in UK Patent No. 1055713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924 and 3,767,448, and JP-A Nos. 49-106821, and 57-14835.

Also, two or more types of solid particles may be used in combination. The average particle size of the solid particles may conveniently be, for example, 1 μm to 100 μm, and is more preferably 4 μm to 30 μm. The usage amount of the solid particles may conveniently be 0.01 $g/m^2$ to 0.5 $g/m^2$, and is more preferably 0.02 $g/m^2$ to 0.3 $g/m^2$.

The releasing agent added to the toner image-receiving layer of the present invention may also comprise different derivatives thereof, oxides, refined products and mixtures. These may also have reactive substituents.

The melting point (° C.) of this releasing agent is preferably 70° C. to 95° C., and more preferably 75° C. to 90° C. from the viewpoints of offset-resistance and paper transport properties.

The releasing agent is also preferably a water-dispersible releasing agent, from the viewpoint of compatibility when a water-dispersible thermoplastic resin is used as the thermoplastic resin of the toner image-receiving layer.

The content of the releasing agent in the toner image-receiving layer is preferably 0.1% by mass to 20% by mass, more preferably 0.3% by mass to 10.0% by mass and still more preferably 0.5% by mass to 8.0% by mass.

—Other Components—

Examples of other components are various additives which may be added to improve the thermodynamic properties of the toner image-receiving layer. Examples of the other components include colorants, plasticizers, fillers, crosslinking agents, charge control agents, emulsifiers, dispersants, and the like. It is preferred that the other components contained in the toner image-receiving layer have hollow particles, and particularly preferred that the pigment has hollow particles, as the toner image-receiving layer then has excellent heat conductivity (low heat conductivity) during image fixing.

—Colorant—

Examples of colorants include optical whitening agents, white pigments, colored pigments, dyes, and the like.

The aforesaid optical whitening agent has absorption in the near-ultraviolet region, and is a compound which emits fluorescence at 400 nm to 500 nm. The various optical whitening agents known in the art may be used without any particular limitation. Examples of the optical whitening agent include the compounds described in "*The Chemistry of Synthetic Dyes*" Volume V, Chapter 8 edited by KVeenRataraman. Specific examples include stilbene compounds, coumarin compounds, biphenyl compounds, benzo-oxazoline compounds, naphthalimide compounds, pyrazoline compounds, carbostyryl compounds, and the like. Examples of these include white furfar-PSN, PHR, HCS, PCS, and B from Sumitomo Chemicals, UVITEX-OB from Ciba-Geigy, and the like.

Examples of white pigments are the inorganic pigments described in the "fillers," (for example, titanium oxide, calcium carbonate, and the like). Examples of organic pigments include various pigments and azo pigments described in JP-A No. 63-44653, (for example, azo lakes such as carmine 6B and red 2B, insoluble azo compounds such as monoazo yellow, disazo yellow, pyrazolo orange, Balkan orange, and condensed azo compounds such as chromophthal yellow and chromophthal red), polycyclic pigments (for example, phthalocyanines such as copper phthalocyanine blue and copper phthalocyanine green), thioxadines such as thioxadine violet, isoindolinones such as isoindolinone yellow, surenes such as perylene, perinon, hulavanthoron and thioindigo, lake pigments (e.g., malachite green, rhodamine B, rhodamine G and Victoria blue B), and inorganic pigments (for example, oxides, titanium dioxide and red ocher, sulfates such as precipitated barium sulfate, carbonates such as precipitated calcium carbonates, silicates such as water-containing silicates and anhydrous silicates, metal powders such as aluminum powder, bronze powder and zinc dust, carbon black, chrome yellow and Berlin blue), and the like.

These may be used either alone, or in combination of two or. Of these, titanium oxide is particularly preferred as the pigment.

There is no particular limitation on the form of the pigment. However, hollow particles are preferred from the viewpoint that they have excellent heat conductivity (low heat conductivity) during image fixing.

The various dyes known in the art may be used as the aforesaid dye.

Examples of oil-soluble dyes include anthraquinone compounds, azo compounds, and the like.

Examples of water-insoluble dyes include vat dyes such as C.I.Vat violet 1, C.I.Vat violet 2, C.I.Vat violet 9, C.I.Vat violet 13, C.I.Vat violet 21, C.I.Vat blue 1, C.I.Vat blue 3, C.I.Vat blue 4, C.I.Vat blue 6, C.I.Vat blue 14, C.I.Vat blue 20 and C.I.Vat blue 35, or the like; disperse dyes such as C.I. disperse violet 1, C.I. disperse violet 4, C.I. disperse violet 10, C.I. disperse blue 3, C.I. disperse blue 7, C.I. disperse blue 58, or the like; and oil-soluble dyes such as C.I. solvent violet 13, C.I. solvent violet 14, C.I. solvent violet 21, C.I. solvent violet 27, C.I. solvent blue 11, C.I. solvent blue 12, C.I. solvent blue 25, C.I. solvent blue 55, or the like.

Colored couplers used in silver halide photography may also be preferably used.

A content ($g/m^2$) of the colorant in the aforesaid toner image-receiving layer (surface) is preferably 0.1 $g/m^2$ to 8 $g/m^2$, and more preferably 0.5 $g/m^2$ to 5 $g/m^2$.

If the content of colorant is less than 0.1 $g/m^2$, the light transmittance in the toner image-receiving layer becomes high. If the content of the aforesaid colorant exceeds 8 $g/m^2$, handling becomes more difficult due to cracking, and adhesive resistance.

—Plasticizer—

The plasticizers known in the art may be used without any particular limitation. These plasticizers have the effect of adjusting the fluidity or softening of the toner image-receiving layer due to heat and/or pressure.

The plasticizer may be selected by referring to "Chemical Handbook," (Chemical Institute of Japan, Maruzen), "Plasticizers—their Theory and Application", (ed. Kohichi Murai, Saiwai Shobo), "The Study of Plasticizers, Part 1" and "The Study of Plasticizers, Part 2" (Polymer Chemistry Association), or "Handbook of Rubber and Plastics Blending Agents" (ed. Rubber Digest Co.), or the like.

Some of the plasticizers are listed as high boiling organic solvents, heat solvents, or the like. Examples of the plasticizers include esters (for example, phthalic esters, phosphate esters, aliphatic acid esters, abiethyne acid ester, abietic acid ester, sebacic acid esters, azelinic ester, benzoates, butylates, epoxy aliphatic acid esters, glycolic acid esters, propionic acid esters, trimellitic acid esters, citrates, sulfonates, carboxylates, succinic acid esters, maleates, fumaric acid esters, phthalic esters, stearic acid esters, and the like), amides (for example, aliphatic acid amides and sulfoamides), ethers, alcohols, lactones, polyethyleneoxy compounds, disclosed in JP-A Nos. 59-83154, 59-178451, 59-178453, 59-178454, 59-178455, 59-178457, 62-174754, 62-245253, 61-209444, 61-200538, 62-8145, 62-9348, 62-30247, 62-136646, 62-174754, 62-245253, 61-209444, 61-200538, 62-8145, 62-9348, 62-30247, 62-136646 and 02-235694, or the like.

The aforesaid plasticizers can be mixed into resin.

The plasticizers may be polymers having relatively low molecular weight. In this case, it is preferred that the molecular weight of the plasticizer is lower than the molecular weight of the binder resin to be plasticized. Preferably plasticizers have a molecular weight of 15000 or less, or more preferably 5000 or less. Further, oligomers may also be used as plasticizers. Apart from the compounds mentioned above, there are products such as, for example, Adecasizer PN-170 and PN-1430 from Asahi Denka Co., Ltd.; PARAPLEX-G-25, G-30 and G-40 from C.P.Hall; and, rosin ester 8 L-JA, ester R-95, pentalin 4851, FK 115, 4820, 830, Ruizol 28-JA, Picolastic A75, Picotex LC and Cristalex 3085 from Rika Hercules, Inc, and the like.

The aforesaid plasticizer can be used as desired to relax stress and distortion (physical distortions of elasticity and viscosity, and distortions of mass balance in molecules, binder main chains or pendant portions) which are produced when toner particles are embedded in the toner image-receiving layer.

The plasticizer may be dispersed as microparticles in the toner image-receiving layer, may be phase-separated on the micro level as islands, or may be completely mixed and dissolved in other components such as the binder.

The content of plasticizer in the toner image-receiving layer is preferably 0.001% by mass to 90% by mass, more preferably 0.1% by mass to 60% by mass, and still more preferably 1% by mass to 40% by mass.

The plasticizer may be used for the purposes of adjusting slip properties (improved transportability due to decrease in friction), improving offset at a fixing part (separation of toner or layers onto the fixing part), adjusting curl balance or adjusting charge (forming a toner electrostatic image).

—Filler—

The filler may be an organic or inorganic filler. Reinforcers for binder resins, bulking agents and reinforcements known in the art may be used. This filler may be selected by referring to "Handbook of Rubber and Plastics Additives" (ed. Rubber Digest Co.), "Plastics Blending Agents—Basics and Applications" (New Edition) (Taisei Co.), "The Filler Handbook" (Taisei Co.), or the like.

As the filler, various inorganic fillers (or pigments) can be used. Examples of inorganic pigments include silica, alumina, titanium dioxide, zinc oxide, zirconium oxide, micaceous iron oxide, white lead, lead oxide, cobalt oxide, strontium chromate, molybdenum pigments, smectite, magnesium oxide, calcium oxide, calcium carbonate, mullite, and the like. Silica and alumina are particularly preferred. These fillers may be used either alone or in combination of two or more. It is preferred that the filler has a small particle diameter. If the particle diameter is large, the surface of the toner image-receiving layer tends to become rough.

Silica includes spherical silica and amorphous silica. The silica may be synthesized by the dry method, wet method or aerogel method. The surface of the hydrophobic silica particles may also be treated by trimethylsilyl groups or silicone. Colloidal silica is preferred. The average particle diameter of the silica is preferably 4 nm to 120 nm, and more preferably 4 nm to 90 nm.

The silica is preferably porous. The average pore volume per mass of porous silica is preferably 0.5 ml/g to 3 ml/g, for example.

The alumina includes anhydrous alumina and hydrated alumina. Examples of crystallized anhydrous aluminas which may be used are $\alpha$, $\beta$, $\gamma$, $\delta$, $\xi$, $\eta$, $\theta$, $\kappa$, $\rho$ or $\chi$. Hydrated alumina is preferred to anhydrous alumina. The hydrated alumina may be a monohydrate or trihydrate. Monohydrates include pseudo-boehmite, boehmite and diaspore. Trihydrates include gibbsite and bayerite. The average particle diameter of alumina is preferably 4 nm to 300 nm, and more preferably 4 nm to 200 nm. Porous alumina is preferred. The average pore size of porous alumina is preferably 50 nm to 500 nm. The average pore volume per mass of porous alumina is around 0.3 ml/g to 3 ml/g.

The alumina hydrate can be synthesized by the sol-gel method, in which ammonia is added to an aluminum salt solution to precipitate alumina, or by hydrolysis of an alkali aluminate. Anhydrous alumina can be obtained by dehydrating alumina hydrate by the action of heat.

It is preferred that the filler is 5% by mass to 2000% by mass, relative to the dry mass of the binder in the layer where the filler is to be added.

—Crosslinking Agent—

A crosslinking agent can be added in order to adjust the storage stability or thermoplastic properties of the toner image-receiving layer. Examples of the crosslinking agent include compounds containing two or more reactive groups in the molecule, such as an epoxy group, an isocyanate group, an aldehyde group, an active halogen group, an active methylene group, an acetylene group and other reactive groups known in the art.

The crosslinking agent may also be a compound having two or more groups capable of forming bonds such as hydrogen bonds, ionic bonds, stereochemical bonds, or the like.

The crosslinking agent may be a compound known in the art such as a coupling agent for resin, curing agent, polymerizing agent, polymerization promoter, coagulant, film-forming agent, film-forming assistant, or the like. Examples of the coupling agents include chlorosilanes, vinylsilanes, epoxisilanes, aminosilanes, alkoxyaluminum chelates, titanate coupling agents, and the like. The examples further include other agents known in the art such as those mentioned in "Handbook of Rubber and Plastics Additives" (ed. Rubber Digest Co.).

—Charge Control Agent—

It is preferred that the toner image-receiving layer of the present invention contains a charge control agent to adjust toner transfer and adhesion, and to prevent charge adhesion. The charge adjusting agent may be any charge adjusting agent known in the art. Examples of the charge control agent include surfactants such as a cationic surfactant, an anionic surfactant, an amphoteric surfactant, a nonionic surfactant, or the like; polymer electrolytes, electroconducting metal oxides, and the like. Examples include cationic charge inhibitors such as quaternary ammonium salts, polyamine derivatives, cation-modified polymethylmethacrylate, cation-modified polystyrene, or the like; anionic charge inhibitors such as alkyl phosphates, anionic polymers, or the like; and nonionic charge inhibitors such as polyethylene oxide, or the like. The examples are not limited thereto, however.

When the toner has a negative charge, it is preferred that the charge adjusting agent blended with the toner image-receiving layer is, for example, cationic or nonionic.

Examples of electroconducting metal oxides include ZnO, $TiO_2$, $SnO_2$, $Al_2O_3$, $In_2O_3$, $SiO_2$, MgO, BaO, $MoO_3$, and the like. These electroconducting metal oxides may be used alone, or may be used in the form of a complex oxide. Moreover, the metal oxide may contain other elements. For example, ZnO may contain Al, In, or the like, $TiO_2$ may contain Nb, Ta, or the like, and $SnO_2$ may contain (or, dope) Sb, Nb, halogen elements, or the like.

—Other Additives—

The materials used to obtain the toner image-receiving layer of the present invention may also contain various additives to improve image stability when output, or to improve stability of the toner image-receiving layer itself. Examples of the additives used for these purposes include antioxidants, age resistors, degradation inhibitors, anti-ozone degradation inhibitors, ultraviolet light absorbers, metal complexes, light stabilizers, preservatives, fungicides and the like.

Examples of the antioxidants include chroman compounds, coumarane compounds, phenol compounds (for example, hindered phenols), hydroquinone derivatives, hindered amine derivatives, spiroindan compounds, and the like. The antioxidants can be found, for example, in JP-A No. 61-159644.

Examples of the age resistors can be found in "Handbook of Rubber and Plastics Additives," Second Edition (1993, Rubber Digest Co.), pp 76-121.

Examples of the ultraviolet light absorbers include benzotriazo compounds (described in U.S. Pat. No. 3,533,794), 4-thiazolidone compounds (described in U.S. Pat. No. 3,352,681), benzophenone compounds (described in JP-A No. 46-2784), ultraviolet light absorbing polymers (described in JP-A No. 62-260152).

Examples of the metal complexes can be found in U.S. Pat. Nos. 4,241,155, 4,245,018, 4,254,195, and JP-A Nos. 61-88256, 62-174741, 63-199248, 01-75568, 01-74272.

The ultraviolet light absorbers and the light stabilizers can be found in "Handbook of Rubber and Plastics Additives", Second Edition (1993, Rubber Digest Co.), pp 122-137 may also be used.

Photographic additives known in the art may also be added to the material used to obtain the toner image-receiving layer of the present invention as described above. Examples of the photographic additives can be found in the Journal of Research Disclosure (hereafter referred to as RD) No. 17643 (December 1978), No. 18716 (November 1979) and No. 307105 (November 1989). The relevant sections are shown below.

TABLE 1

| Type of additive | RD17643 | RD18716 | RD307105 |
|---|---|---|---|
| 1. Whitener | p24 | p648, right-hand column | p868 |
| 2. Stabilizer | p24-25 | p649, right-hand column | p868-870 |
| 3. Light absorbers (ultraviolet light absorbers) | p24-25 | p649, right-hand column | p873 |
| 4. Pigment image stabilizers | p25-26 | p650, right-hand column | p872 |
| 5. Filmhardening agents | p25-26 | p651, right-hand column | p874-875 |
| 6. Binders | p25 | p651, left-hand colum | p873-874 |
| 7. Plasticizers, lubricants | p26 | p650, right-hand column | p876 |
| 8. Coating assistants | p26-27 | p650, right-hand column | p875-876 |
| 9. Antistatic agents | p27 | p650, right-hand column | p867-877 |
| 10. Matting agents | | | p878-879 |

The toner image-receiving layer of the present invention is formed by applying a coating solution which contains the polymer used for the toner image-receiving layer with a wire coater or the like to the support, and drying the coating solution. The coating solution is prepared by dissolving or uniformly dispersing an additive such as a thermoplastic polymer, a plasticizer, or the like, into an organic solvent such as alcohol, ketone, or the like. The organic solvent used here may for example be methanol, isopropyl alcohol, methyl ethyl ketone, or the like. If the polymer used for the toner image-receiving layer is water-soluble, the toner image-receiving layer can be prepared by applying an aqueous solution of the polymer to the support. Polymers which are not water-soluble may be applied to the support in an aqueous dispersion.

The film-forming temperature of the polymer used in the present invention is preferably room temperature or higher, from the viewpoint of pre-print storage, and preferably 100° C. or lower, from the viewpoint of fixing toner particles.

The toner image-receiving layer of the present invention is coated so that the amount of coating in mass after drying is preferably 1 $g/m^3$ to 20 $g/m^3$, and more preferably 4 $g/m^3$ to 15 $g/m^3$.

There is no particular limitation on the thickness of the toner image-receiving layer. However, it is preferably 1 μm to 30 μm, and more preferably 2 μm to 20 μm.

—Physical Properties of Toner Image-receiving Layer—

It is preferred that the toner image-receiving layer has a high degree of whiteness. This whiteness is measured by the method specified in JIS P 8123, and is preferably 85% or more. It is preferred that the spectral reflectance is 85% or more in the wavelength of 440 nm to 640 nm, and that the difference between the maximum spectral reflectance and minimum spectral reflectance in this wavelength is within 5%. Further, it is preferred that the spectral reflectance is 85% or more in the wavelength of 400 nm to 700 nm, and that the difference between the maximum spectral reflectance and the minimum spectral reflectance in the wavelength is within 5%.

Specifically, for the whiteness, the value of L* is preferably 80 or higher, more preferably 85 or higher, and still more preferably 90 or higher in a CIE 1976 (L*a*b*) color space. The color tint of the white color is preferably as neutral as possible. Regarding the color tint of the whiteness, the value of $(a^*)^2+(b^*)^2$ is preferably 50 or less, more preferably 18 or less and still more preferably 5 or less in a (L*a*b*) space.

It is preferred that the toner image-receiving layer has a high surface gloss. The 45° gloss luster is preferably 60 or higher, more preferably 75 or higher, and still more preferably 90 or higher, over the whole range from white where there is no toner, to black where toner is densed at maximum.

However, the gloss luster is preferably 110 or less. If it exceeds 110, the image has a metallic appearance which is undesirable.

Gloss luster may be measured by JIS Z 8741.

It is preferred that the toner image-receiving layer has a high smoothness. The arithmetic mean roughness (Ra) is preferably 3 μm or less, more preferably 1 μm or less, and still more preferably 0.5 μm or less, over the whole range from white where there is no toner, to black where toner is densed at maximum.

Arithmetic mean roughness may be measured by JIS B 0601, B 0651, and B 0652.

It is preferred that the toner image-receiving layer has one of the following physical properties, more preferred that it has several of the following physical properties, and most preferred that it has all of the following physical properties.

(1) Tg (glass transition temperature) of the toner image-receiving layer is 30° C. or higher, and Tg of the toner+20° C., or less.

(2) T1/2 (a softening point measured by ½ method) of the toner image-receiving layer is 60° C. to 200° C., and preferably 80° C. to 170° C. Herein, the softening point measured by the ½ method is measured using a special apparatus. The softening point is taken to be the temperature which is ½ of the difference in piston strokes when flow starts and flow ends at various temperatures, when the temperature is increased at a predetermined uniform rate after a residual heat time of, for example, 300 seconds, at the initial set temperature (e.g., 50° C.), while applying a predetermined extrusion load under specific conditions.

(3) Tfb (flow initiating temperature) of the toner image-receiving layer is 40° C. to 200° C., and Tfb of the toner image-receiving layer is preferably Tfb of the toner +50° C., or less.

(4) The temperature at which the viscosity of the toner image-receiving layer is $1\times10^5$ cp is 40° C. or higher, and lower than the corresponding temperature for the toner.

(5) At a fixing temperature of the toner image-receiving layer, the storage elasticity modulus (G') is $1\times10^2$ Pa to $1\times10^5$ Pa, and the loss elasticity modulus (G") is $1\times10^2$ Pa to $1\times10^5$ Pa.

(6) The loss tangent (G'/G"), which is the ratio of the loss elasticity modulus (G") and the storage elasticity modulus (G') at a fixing temperature of the toner image-receiving layer, is 0.01 to 10.

(7) The storage modulus (G') at a fixed temperature of the toner image-receiving layer is −50 to +2500, relative to the storage elasticity modulus (G") at a fixing temperature of the toner.

(8) The inclination angle on the toner image-receiving layer of the molten toner is 50° or less, and particularly preferably 40° or less. The toner image-receiving layer preferably satisfies the physical properties described in Japanese Patent No. 2788358, and JP-A Nos. 07-248637, 08-305067 and 10-239889.

Physical property (1) may be measured by a differential scanning calorimeter (DSC). Physical properties (2) and (3) may be measured, for example, by Flow Tester CFT-500 or 500D manufactured by Shimadzu Corporation. Physical properties (5) to (7) may be measured using a rotating rheometer (for example, Dynamic Analyser RADII manufactured by Rheometric Scientific F.E.Ltd). Physical property (8) may be measured by the process disclosed in JP-A No. 8-334916 using a Contact Angle Measurement Apparatus, Kyowa Interface Science Co., LTD.

It is preferred that the surface electrical resistance of the toner image-receiving layer is within the range of $1\times10^6$ Ω/cm$^2$ to $1\times10^{15}$ Ω/cm$^2$ (under conditions of 25° C., 65% RH).

If the surface electrical resistance is less than $1\times10^6$ Ω/cm$^2$, the toner amount transferred to the toner image-receiving layer is insufficient, and the density of the toner image obtained may be too low. On the other hand, if the surface electrical resistance exceeds $1\times10^{15}$ Ω/cm$^2$, more charge than necessary is produced during transfer. Therefore, toner is transferred insufficiently, image density is low and static electricity develops causing dust to adhere during handling of the electrophotographic image-receiving sheet, or misfeed, overfeed, discharge marks or toner transfer dropout may occur.

The surface electrical resistance of the surface on the opposite side of the support to the toner image-receiving layer is preferably $5\times10^8$ Ω/cm$^2$ to $3.2\times10^{10}$ Ω/cm$^2$, and more preferably $1\times10^9$ Ω/cm$^2$ to $1\times10^{10}$ Ω/cm$^2$.

In the present invention, the aforesaid surface electrical resistances were measured based on JIS K 6911. The sample was left with air-conditioning for 8 hours or more at a temperature of 20° C. and the humidity of 65%. Measurements were made using an R8340 manufactured by Advantest Ltd., under the same environmental conditions after giving an electric current for 1 minute at an applied voltage of 100V.

[Other Layers]

Other layers may include, for example, a surface protective layer, backing layer, contact improving layer, intermediate layer, underlayer, cushion layer, charge control (inhibiting) layer, reflecting layer, tint adjusting layer, storage ability improving layer, anti-adhering layer, anti-curl layer, smoothing layer, and the like. These layers may be used either alone, or in combination of two or more.

—Surface Protective Layer—

A surface protective layer is provided on the surface of the toner image-receiving layer to protect the surface of the electrophotographic image-receiving sheet of the present invention, to improve storage properties, to improve ease of handling, to facilitate writing, to improve transferring within an equipment, to confer anti-offset properties, or the like. The surface protective layer may comprise one layer, or two or more layers. In the surface protective layer, various thermoplastic resins or thermocuring resins may be used as binders, and are preferably the same types of resins as those of the toner image-receiving layer. However, the thermodynamic properties and electrostatic properties are not necessarily identical to those of the toner image-receiving layer, and may be individually optimized.

The surface protective layer may comprise the various additives described above which can be used for the toner image-receiving layer. In particular, in addition to the releasing agents used in the present invention, the surface protective layer may include other additives, for example matting agents or the like. The matting agents may be any of those used in the related art.

From the viewpoint of fixing properties, it is preferred that the outermost surface layer of the electrophotographic image-receiving sheet of the present invention (which refers to, for example, the surface protective layer, if formed) has good compatibility with the toner. Specifically, it is preferred that the contact angle with molten toner is for 0° to 40°.

—Backing Layer—

It is preferred that, in the electrophotographic image-receiving sheet of the present invention, a backing layer is provided on the opposite side of the support to the toner image-receiving layer in order to confer undersurface output compatibility, and to improve undersurface output image quality, curl balance and transferring properties within equipment.

There is no particular limitation on the color of the backing layer. However, if the electrophotographic image-receiving sheet of the invention is a double-sided output image-receiving sheet where an image is formed also on the undersurface, it is preferred that the backing layer is also white. It is preferred that the whiteness and spectral reflectance are 85% or more, as in the case of the upper surface.

To improve two-sided output compatibility, the backing layer may have an identical structure to that of the toner image-receiving layer. The backing layer may comprise the various additives described hereintofore. Of these additives, matting agents and charge control agents are particularly suitable. The backing layer may be a single layer, or may have a laminated structure comprising two or more layers.

Further, if releasing oil is used for the fixing roller, or the like, to prevent offset during fixing, the backing layer may have oil absorbing properties.

—Contact Improving Layer—

In the electrostatic image-receiving sheet of the present invention, it is preferred to form a contact improving layer in order to improve the contact between the support and the toner image-receiving layer. The contact improving layer may contain the various additives described above. Of those, crosslinking agents are particularly preferred to be blended in the contact improving layer. Furthermore, to improve accepting properties to toner, it is preferred that the electrostatic image-receiving sheet of the present invention further comprises a cushion layer between the contact improving layer and the toner image-receiving layer.

—Intermediate Layer—

An intermediate layer may be formed, for example, between the support and the contact improving layer, the contact improving layer and the cushion layer, the cushion layer and the toner image-receiving layer, or the toner image-receiving layer and the storage improving layer. In an electrostatic image-receiving sheet comprising a support, a toner image-receiving layer and an intermediate layer, the intermediate layer may be provided, for example, between the support and toner image-receiving layer.

(Physical Properties of the Electrophotographic Image-receiving Sheet)

If the tension of the polymer contained in the toner image-receiving layer of the above electrophotographic image-receiving sheet is higher than the tension of the toner, and the difference is bigger than a certain amount, transfer of toner to the image-receiving sheet is satisfactory and the adhesion of the toner to the toner image-receiving layer improves, which is desirable. The surface tension of the polymer and the surface tension of the toner are measured at the toner fixing temperature. Under the measurement conditions, the polymer and toner are in a molten state, and the surface tension is measured by the pendant-drop method, the bubble pressure method, or the like. For example, in the case of the pendant-drop method, the polymer and toner are melted to become liquid at the toner fixing temperature, and the polymer and toner are extruded from a needle to form liquid drops which are then analyzed and measured. In this case, the tension of the polymer ($\gamma_p$) (mN/m) and the tension of toner ($\gamma_t$) (mN/m) satisfy the following relation: $\gamma_p-\gamma_t \geqq 8$, and preferably satisfy the relation of: $\gamma_p-\gamma_t \geqq 9$.

Herein, the polymer is one or more types of polymer contained in the toner image-receiving layer. The polymer does not contain an additive of the additives of the toner image-receiving layer.

Herein, if the contact angle on the fixing belt surface is larger than the contact angle on the toner image-receiving layer surface in the image-receiving sheet, and the difference is a certain value or more, the image-receiving sheet and fixing belt separate well, toner offset and image-receiving layer offset can be prevented, and brilliance improves, which is desirable. The contact angle may be measured, for example, with the static drop method using toner which is melted at the fixing temperature. A piece of toner hardened into a cube of about 2 mm square is placed on the image-receiving layer surface which is heated to the toner fixing temperature, and the contact angle when the toner is melted, is measured. In this case, the contact angle ($\theta_1$) (°) towards toner image-receiving layer surface and the contact angle ($\theta_2$) (°) towards the fixing belt surface, satisfy the following relation:

$$\theta_2-\theta_1 \geqq 10; \text{ and}$$

preferably satisfy the relation of:

$$\theta_2-\theta_1 \geqq 13.$$

If the surface free energy of the toner image-receiving layer surface in an image-receiving sheet is higher than the surface free energy in the fixing belt surface, and the difference is more than a certain value, separation of the toner image-receiving layer and fixing belt is satisfactory, offset of the non-image part to which toner has not adhered does not occur, and brilliance also improves, which is desirable. Regarding surface free energy, the contact angles ($\theta_i$) and ($\theta_j$) of the toner image-receiving layer surface and the fixing belt surface are measured relative to two kinds of liquids "i," and "j," and a dispersibility component ($g^d$), a polar component ($g^p$) and a solid surface free energy (G) are calculated from the following expanded Fowks equation:

$$G=g^d+g^p;$$

$$\gamma_{sp} = \frac{\begin{vmatrix} \sqrt{\gamma_{li}^d} & \frac{\gamma_{li}}{2}(1+\cos\theta_i) \\ \sqrt{\gamma_{li}^d} & \frac{\gamma_{lj}}{2}(1+\cos\theta_j) \end{vmatrix}^2}{\begin{vmatrix} \sqrt{\gamma_{li}^d} & \sqrt{\gamma_{li}^p} \\ \sqrt{\gamma_{lj}^d} & \sqrt{\gamma_{lj}^p} \end{vmatrix}^2}$$

In the equation, $\gamma_{li}$, and $\gamma_{lj}$ are each the surface tensions of liquids "i," and "j," $\gamma^d_{li}$, and $\gamma^d_{lj}$ are the dispersion force components of the surface tensions of liquids "i," and "j." $\gamma^p_{li}$, and $\gamma^p_{lj}$ are each the polar force components of liquids "i," and "j," which are eigenvalues of the liquids "i" and "j," respectively. $\theta_i$, and $\theta_j$ are each the contact angles of the liquids "i" and "j."

At this time, the surface free energy ($G_1$) (mN/m) of the surface of the toner image-receiving layer, and the surface free energy ($G_2$) (mN/m) of the surface of the fixing belt satisfy the following equation (III):

$$G_1-G_2 \geqq 10; \quad \text{(III)}$$

and preferably satisfy the relation of: $G_1-G_2 \geqq 15$.

Further, the value ($g^p_1$) (mN/m) of the polar component of the surface free energy of the surface of the toner image-receiving layer, and the value ($g^p_2$) (mN/m) of the polar component of the surface free energy of the surface of the fixing belt, satisfy the following equation:

$$g^p_1 - g^p_2 \geqq 0.3; \text{ and}$$

preferably satisfy the relation of: $g^p_1 - g^p_2 \geqq 2$.

Herein, the surface of the toner image-receiving layer means the surface of the electrophotographic image-receiving sheet of the present invention which is provided above the toner image-receiving layer side.

There is no particular limitation on the thickness of the electrostatic image-receiving sheet of the present invention. The thickness may be suitably selected according to the purpose. The thickness is preferably 50 μm to 350 μm, and more preferably 100 μm to 280 μm.

<Toner>

In the electrostatic image-receiving sheet of the present invention, the toner image-receiving layer receives toner during printing or copying.

The toner contains at least a binder resin and a colorant, but may contain releasing agents and other components, if necessary.

—Toner Binder Resin—

Examples of the binder resin include vinyl monopolyer of: styrenes such as styrene, parachlorostyrene, or the like; vinyl esters such as vinyl naphthalene, vinyl chloride, vinyl bromide, vinyl fluoride, vinyl acetate, vinyl propioniate, vinyl benzoate, vinyl butyrate, or the like; methylene aliphatic carboxylates such as methyl acrylate, ethyl acrylate, n-butyl acrylate, isobutyl acrylate, dodecyl acrylate, n-octyl acrylate, 2-chloroethyl acrylate, phenyl acrylate, α-methyl chloroacrylate, methyl methacrylate, ethyl methacrylate, butyl acrylate, or the like; vinyl nitriles such as acryloniotrile, methacrylonitrile, acrylamide, or the like; vinyl ethers such as vinyl methyl ether, vinyl ethyl ether, vinyl isobutyl ether, or the like; N-vinyl compounds such as N-vinyl pyrrole, N-vinylcarbazole, N-vinyl indole, N-vinyl pyrrolidone, or the like; and vinyl carboxylic acids such as methacrylic acid, acrylic acid, cinnamic acid, or the like. These vinyl monomers may be used either alone, or their copolymers may be used. In addition, various polyesters may be used, and various waxes may be used in combination.

Of these resins, it is preferable to use a resin of the same type as the resin used for the toner image-receiving television layer of the present invention.

—Toner Colorants—

The colorants generally used in the art can be used without limitation. Examples of the colorants include carbon black, chrome yellow, Hansa yellow, benzidine yellow, thuren yellow, quinoline yellow, permanent orange GTR, pyrazolone orange, Balkan orange, watch young red, permanent red, brilliant carmin 3B, brilliant carmin 6B, dippon oil red, pyrazolone red, lithol red, rhodamine B lake, lake red C, rose bengal, aniline blue, ultramarine blue, chalco oil blue, methylene blue chloride, phthalocyanine blue, phthalocyanine green, malachite green oxalate, or the like. Various dyes may also be added such as acridine, xanthene, azo, benzoquinone, azine, anthraquinone, thioindigo, dioxadine, thiadine, azomethine, indigo, thioindigo, phthalocyanine, aniline black, polymethine, triphenylmethane, diphenylmethane, thiazine, thiazole, xanthene, or the like. These colorants may be used either alone, or in combination of a plurality of colorants.

It is preferred that the content of the colorant is 2% by mass to 8% by mass. If the content of colorant is more than 2% by mass, the coloration does not become weaker. If it is 8% by mass or less, transparency does not deteriorate.

—Toner Releasing Agent—

The releasing agent may be in principle any of the waxes known in the art. Polar waxes containing nitrogen such as highly crystalline polyethylene wax having relatively low molecular weight, Fischertropsch wax, amide wax, urethane wax, and the like are particularly effective. For polyethylene wax, it is particularly effective if the molecular weight is 1000 or less, and is more preferably if the molecular weight is 300 to 1000.

Compounds containing urethane bonds have a solid state due to the strength of the cohesive force of the polar groups even if the molecular weight is low, and as the melting point can be set high in view of the molecular weight, they are suitable. The preferred molecular weight is 300 to 1000. The initial materials may be selected from various combinations such as a diisocyane acid compound with a mono-alcohol, a monoisocyanic acid with a mono-alcohol, dialcohol with mono-isocyanic acid, tri-alcohol with a monoisocyanic acid, and a triisocyanic acid compound with a mono-alcohol. To prevent the increase of molecular weight, it is preferred to use a combination of compounds with polyfunctional groups and monofunctional groups, and it is important to use equivalent amounts of functional groups.

Among the initial materials, examples of the monoisocyanic acid compounds are dodecyl isocyanate, phenyl isocyanate and derivatives thereof, naphthyl isocyanate, hexyl isocyanate, benzyl isocyanate, butyl isocyanate, allyl isocyanate, and the like.

Examples of the diisocyanic acid compounds include tolylene diisocyanate 4,4' diphenylmethane diisocyanate, toluene diisocyanate, 1,3-phenylene diisocyanate, hexamethylene diisocyanate, 4-methyl-m-phenylene diisocyanate, isophorone diisocyanate, and the like.

Examples of the mono-alcohols include ordinary alcohols such as methanol, ethanol, propanol, butanol, pentanol, hexanol, heptanol, and the like.

Among the initial materials, examples of the di-alcohols include numerous glycols such as ethylene glycol, diethylene glycol, triethylene glycol, trimethylene glycol, or the like; and examples of the tri-alcohols include trimethylol propane, triethylol propane, trimethanolethane, and the like. The present invention is not necessarily limited these examples, however.

These urethane compounds may be mixed with the resin or the colorant during kneading, as an ordinary releasing agent, and used also as a kneaded-crushed toner. Further, in a case of using an emulsion polymerization cohesion scarification toner, the urethane compounds may be dispersed in water together with an ionic surfactant, polymer acid or polymer electrolyte such as a polymer base, heated above the melting point, and converted to fine particles by applying an intense shear in a homogenizer or pressure discharge dispersion machine to manufacture a releasing agent particle dispersion of 1 μm or less, which can be used together with a resin particle dispersion, colorant dispersion, or the like.

—Toner, Other Components—

The toner of the present invention may also contain other components such as internal additives, charge control agents, inorganic particles, or the like. Examples of the internal additives include metals such as ferrite, magnetite, reduced iron, cobalt, nickel manganesite, or the like; alloys or magnetic bodies such as compounds containing these metals.

Examples of the charge control agents include dyes such as quaternary ammonium salt, nigrosine compounds, dyes made from complexes of aluminum, iron and chromium, or triphenylmethane pigments. The charge control agent can be selected from the ordinary charge control agent. Materials which are hard to become solved in water are preferred from the viewpoint of controlling ionic strength which affects cohesion and stability during melting, and the viewpoint of less waste water pollution.

The inorganic fine particles may be any of the external additives for toner surfaces generally used, such as silica, alumina, titania, calcium carbonate, magnesium carbonate, tricalcium phosphate, or the like. It is preferred to disperse these with an ionic surfactant, polymer acid or polymer base.

Surfactants can also be used for emulsion polymerization, seed polymerization, pigment dispersion, resin particle dispersion, releasing agent dispersion, cohesion or stabilization thereof. Examples of the surfactants include anionic surfactants such as sulfuric acid ester salts, sulfonic acid salts, phosphoric acid esters, soaps, or the like; cationic surfactants such as amine salts, quaternary ammonium salts, or the like. It is also effective to use non-ionic surfactants such as polyethylene glycols, alkylphenol ethylene oxide adducts, polybasic alcohols, or the like. These may generally be dispersed by a rotary shear homogenizer or a ball mill, sand mill, dyno mill, or the like, all of which contain the media.

The toner may also contain an external additive, if necessary. Examples of the additive include inorganic powder, organic particles, and the like. Examples of the inorganic particles include $SiO_2$, $TiO_2$, $Al_2O_3$, CuO, ZnO, $SnO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like. Examples of the organic particles include aliphatic acids, derivatives thereof, and the like, powdered metal salts thereof, and resin powders such as fluorine resin, polyethylene resin, acrylic resin, or the like. The average particle diameter of the powder may be, for example, 0.01 μm to 5 μm, and is more preferably 0.1 μm to 2 μm.

There is no particular limitation on the process of manufacturing the toner, but it is preferably manufactured by a process comprising the steps of (i) forming cohesive particles in a dispersion of resin particles to manufacture a cohesive particle dispersion, (ii) adding a fine particle dispersion to the aforesaid cohesive particle dispersion so that the fine particles adhere to the cohesive particles, thus forming adhesion particles, and (iii) heating the aforesaid adhesion particles which melt to form toner particles.

—Toner Physical Properties—

It is preferred that the volume average particle diameter of the toner of the present invention is from 0.5 μm to 10 μm.

If the volume average particle diameter of the toner is too small, it may have an adverse effect on handling of the toner (supplementation, cleaning properties, fluidability, or the like), and particle productivity may decline. On the other hand, if the volume average particle damage is too large, it may have an adverse effect on image quality and resolution due to granulariness and transfer properties.

It is preferred that the toner of the present invention satisfies the aforesaid toner volume average particle diameter range, and that the volume average particle distribution index (GSDv) is 1.3 or less.

It is preferred that the ratio (GSDv/GSDn) of the volume average polymer distribution index (GSDv) and the number average particle distribution index (GSDn) is at least 0.95.

It is preferred that the toner of the present invention satisfies the aforesaid volume average particle diameter range, and that the average value of the formation coefficient expressed by the following equation is 1.00 to 1.50.

$$\text{Formation coefficient}=(\pi\times L^2)/(4\times S)$$

(where, L is the maximum length of the toner particles, and S is the projection surface area of a toner particle).

If the toner satisfies the above conditions, it has a desirable effect on image quality, and in particular, granulariness and resolution. Also, there is less risk of dropout and blur accompanying transfer, and less risk of adverse effect on handling properties even if the average particle diameter is small.

The storage elasticity modulus G' (measured at an angular frequency of 10 rad/sec) of the toner itself at 150° C. is 10 Pa to 200 Pa, which is suitable for improving image quality and preventing offset in a fixing step.

<Image-forming Process>

An image-forming process according to the present invention comprises, in a first aspect, the step of forming a toner image on the electrophotographic image-receiving sheet of the present invention, the step of heating and pressuring a surface of the electrophotgrahic image-receiving sheet on which the toner image is formed with a fixing bet and a roller, and the step of cooling the surface, so as to separate the surface from the fixing belt.

An image-forming process comprises, in a second aspect, the step of forming a toner image on the electrophotographic image-receiving sheet of the present invention, the step of fixing the toner image with a heat roller; the step of heating and pressuring a surface of the electrophotgrahic image-receiving sheet on which the toner image is formed with a fixing bet and a roller; and the step of cooling the surface, so as to separate the surface from the fixing belt.

The process for transferring of the present invention employs ordinary processes employed in a process for electrophogography. Specifically, one of the ordinary processes may be directly transferring a toner image formed on a development roller onto an electrophotographic image-receiving sheet. The process may be the intermediate transfer belt type process, where a toner image is first transferred onto an intermediate transfer belt, and is then transferred onto an electrophotographic image-receiving sheet. From the viewpoints of environment stability and higher quality image, the intermediate transfer belt type process is more preferable.

Regarding the electrophotographic image-receiving material of the present invention, the toner transferred to the image-receiving material is fixed on the image-receiving material using an electrophotographic apparatus comprising a fixing belt. The belt fixing method may for example be the oilless type as described in JP-A No. 11-352819, or the method where a second transfer and fixing are realized simultaneously as described in JP-A Nos. 11-231671 and 05-341666. An electrophotographic apparatus comprising a fixing belt according to the present invention may be an electrophotographic apparatus comprising for example at least a heating and pressurizing part which can melt and pressurize the toner, a fixing belt which can transfer the image-receiving material with toner adhering while in contact with the toner image-receiving layer, and a cooling part which can cool the heated image-receiving material while it is still adhering to the fixing belt. By using the electrophotographic image-receiving material comprising the toner image-receiving layer in the electrophotographic apparatus comprising the fixing belt, toner adhering to the toner image-receiving layer is fixed in fine detail without spreading into the image-receiving material, and the molten toner is cooled/solidified, while adhering closely to the fixing belt. The toner is received while it is completely embedded in the toner image-receiving layer. Therefore, there are no image discrepancies, and a brilliant and smooth toner image is obtained.

The electrophotographic image-receiving sheet formed in the present invention is particularly suitable for forming an image by the oilless belt fixing method, and it permits a large improvement of offset. However, other methods for forming an image may also likewise be used.

For example, by using the electrophotographic image-receiving sheet of the present invention, a full-color image can easily be formed while improving image quality and preventing crackings. A full-color image can be formed using an electrophotographic apparatus capable of forming full-color images. An ordinary electrophotographic apparatus comprises an image-receiving paper transport part, latent image-forming part, and developing part disposed in the vicinity of the latent image forming part. Depending on the type, it may also comprise a latent image-forming part in the center of the apparatus and a toner image intermediate transfer part in the vicinity of the image-receiving paper transport part.

To improve image quality, adhesive transfer or heat assistance transfer may be used instead of the electrostatic transfer or bias roller transfer, or in conjunction therewith. Specific details of these methods are given for example in JP-A Nos. 63-113576 and 05-341666. It is particularly preferred to use an intermediate transfer belt in the heat assistance transfer method. Also, it is preferred to provide a cooling apparatus for the intermediate belt after toner transfer or in the latter half of transfer to the electrophotographic image-receiving sheet. Due to this cooling apparatus, the toner (toner image) is cooled to the softening temperature of the binder resin or the glass transition temperature of the toner +10° C. or less, hence the image is transferred to the electrophotographic image-receiving sheet efficiently and can be peeled away from the intermediate belt.

Fixing is an important step which influences the gloss and smoothness of the final image. The fixing method may be fixing by a heat and pressure roller, or belt fixing using a belt, but from the viewpoint of image quality such as gloss and smoothness, belt fixing is preferred. Belt fixing methods known in the art include for example an oil-less type of belt fixing described in JP-A No. 11-352819, and the method where second transfer and fixing are realized simultaneously described in JP-A Nos. 11-231671 and 05-341666. Further, a first fixing may also be performed by a heat roller before the pressurizing and heating by the fixing belt and fixing roller.

The surface of the fixing belt may receive a surface treatment of a silicone compound, fluorine compound or a combination thereof to prevent peeling of the toner and prevent offset of toner components. Also, it is preferred to provide a belt cooling device in the latter half of fixing, which ameliorates the peeling of the electrophotographic image-receiving sheet. The cooling temperature is preferably the softening point or lower, or the glass transition temperature +10° C. or lower, of the toner binder resin and/or the polymer in the toner image-receiving layer of the electrophotographic image-receiving sheet. On the other hand, in the first stage of fixing, the temperature of the toner image-receiving layer or toner of the electrophotographic image-receiving sheet must be raised to the temperature at which they become sufficiently softened. Specifically, it is preferred in practice that the cooling temperature is 70° C. or less, and 30° C. or more, and that it is 180° C. or more, and 100° C. or less in the initial stage of fixing.

Hereafter, an example of the image-forming apparatus having a typical fixing belt will be described referring into FIG. 1. It should however be understood that the present invention is not limited to the aspect shown in FIG. 1.

First, a toner (12) is transferred onto an electrophotographic image-receiving sheet (1) by an apparatus for forming an image, (which is not shown in FIG. 1). The image-receiving sheet (1) to which the toner (12) adheres is transferred to a point A by a transferring mechanism (which is not shown in FIG. 1), and is transported between a heat roller (14) and pressure roller (15), and is thereby heated and pressurized to a temperature (fixing temperature) and pressure at which a toner image-receiving layer (2) of the electrophotographic image-receiving sheet (1), or the toner (12), are sufficiently softened.

Herein, the fixing temperature means the temperature of the toner image-receiving layer surface measured at the position of the heat roller (14), pressure roller (15) and nip part at the point A, and is for example 80° C. to 190° C., and more preferably 100° C. to 170° C. The pressure means the pressure of the toner image-receiving layer surface measured at the heat roller (14), pressure roller (15) and nip part, and is for example 1 kg/cm$^2$ to 10 kg/cm$^2$, and more preferably 2 kg/cm$^2$ to 7 kg/cm$^2$. While the electrophotographic image-receiving sheet (1) is thus heated and pressurized, and is transported to the cooling apparatus (16) by a fixing belt (13), a releasing agent, (not shown in FIG. 1) which was present dispersed in the toner image-receiving layer (2), is sufficiently heated so as to become melted, and is transferred onto a surface of the toner image-receiving layer. The transferred releasing agent forms a layer (film) of releasing agent on the surface of the toner image-receiving layer. Thereafter, the electrophotographic image-receiving sheet (1) is transported to the cooling apparatus (16) with the fixing belt (13), and is cooled for example to the softening point of the binder resin or lower, or the glass transition temperature +10° C. or lower of the binder resin used in the polymer and/or toner of the toner image-receiving layer, which is preferably 20° C. to 80° C., and more preferably room temperature (25° C.). In this way, the layer (film) of releasing agent formed on the surface of the toner image-receiving layer is cooled and solidified, and a releasing agent layer is formed due to change in the releasing agent inside the toner image-receiving layer.

The cooled electrophotographic image-receiving sheet (1) is then transported to the point B by the fixing belt (13), and the fixing belt (13) is spanned around and is rotated by a tension roller (17). Therefore, at the point B, the electrophotographic image-receiving sheet (1) and fixing belt (13) become separated. It is preferred to have a smaller diameter of the tension roller, so that the electrophotographic image-receiving sheet separates from the belt with its own rigidity (strength).

The image-forming process to form an image on the electrophotographic image-receiving sheet of the present invention is not limited to the process shown in FIG. 1, as long as it is an electrophotographic process using a fixing belt. Hence, any of the ordinary electrophotographic methods may be used.

For example, a color image may suitably be formed on the electrophotographic image-receiving sheet of the present invention. A color image can be formed, using an electrophotographic apparatus which permits forming a full color image. An ordinary electrophotographic apparatus comprises an image-receiving sheet transport part, latent image-forming part, and developing part disposed in the vicinity of the latent image forming part. Depending on the type, it may also comprise, in the center of the apparatus, a toner image intermediate transfer part in the vicinity of a latent image-forming part and an image-receiving sheet transport part.

To improve image quality, adhesive transfer or heat assistance transfer methods may be used, instead of electrostatic transfer, bias roller transfer, or in combination of the heat assistance transfer methods, the electrostatic transfer, and/or bias roller transfer. The detailed structures are described, for example, in JP-A Nos. 63-113576 and 05-341666. The intermediate transfer belt in the heat assistance transfer method is particularly preferred when small particle diameter toner is used.

According to the image-forming process of the present invention, peeling of the image-receiving sheet and toner or offset of the image-receiving sheet and toner components can be prevented, even if an oilless machine providing no fixing oil is used. A stable paper provision can be realized, and a good image with more gloss than ever, and a plenty of photographic features, can be obtained.

The present invention will now be described referring to the detailed examples, but it should be understood that the present invention is not be limited to the following Examples.

In the following examples and comparative examples, "%" and "parts" each refer to "% by mass" and "part(s) by mass."

EXAMPLES 1 TO 14 AND COMPARATIVE EXAMPLES 1 TO 3

Image-receiving sheets for electrophotography of the Examples 1 to 14 and Comparative Examples 1 to 3 were prepared as the following manner.

<Support>

A support "A" was manufactured as follows: Water-dispersible anatase titanium dioxide was internally added to have a content of 1.1 g/m$^2$, and a high quality paper manufactured so that the center line average roughness was 1.2 μm (basic weight of pulp tissue: 160 g/m$^2$). Using the high quality paper as a raw paper, high density polyethylene (MI=10 g/10 minutes, density 0.950 g/cm$^3$) containing 1.1 g/m$^2$ of rutile titanium dioxide was extruded onto the back surface by a coating method (310° C.), so as to form a back polyethylene layer having a thickness of 15 μm.

A support "B" was manufactured as follows:

A 1/1 (mass ratio) blend (containing 3.0 g/m$^2$ anatase titanium dioxide) of high density polyethylene (MI=8 g/10 minutes, density 0.950 g/cm$^3$), and low density polyethylene (MI=7 g/10 minutes, density 0.923 g/cm$^3$) was extruded by the coating method on the top surface of the high quality paper, so as to form a layer which has polyethylene on its surface having a thickness of 13 μm.

Corona charge treatment was given to the polyethylene layers on the top and back surfaces of supports A and B shown in Table 2. The undercoat composition below was prepared and applied to the top surface by a wire coater, so as to give a thickness after drying of 0.1 μm. The back layer composition below was prepared and applied to the back surface by a wire coater so that the amount of coating after drying was 4.5 g/m$^2$.

<Top Surface Undercoat Layer Composition>

| | |
|---|---|
| Gelatin | 5 g |
| Water | 95 g |

<Back Layer Composition>

| | |
|---|---|
| Polyester resin (Byronal MD-1200, Toyobo Co., Ltd) | 100 g |
| Matting agent (Epostar L15, NIPPON SHOKUBAI CO., LTD.) | 30 g |
| Ethanol | 60 g |
| Water | 200 g |

<Toner Image-receiving Layer Composition>

Examples 1 to 14 and Comparative Examples 1 to 3 were manufactured by coating the following toner image-receiving compositions A and B on the top surface undercoat by a wire coater, so as to give the amount of coating after drying of 5.5 g/m$^2$, using the releasing agents in Table 2. Therefore, in the Examples and the Comparative Examples, the layer forming the electrophotographic image-receiving sheet surface is a toner image-receiving layer containing a predetermined releasing agent.

<Composition A of Toner Image-receiving Layer>

| | |
|---|---|
| Polyester resin (Tufton U-5, Kao Corporation) | 100 g |
| Releasing agent (Table 2) | x g |
| Triphenylphosphate | 9 g |
| Titanium dioxide (Tipec (registered trademark) A-220, ISHIHARA SANGYO KAISHA, LTD.) | 15 g |
| Methyl ethyl ketone (hereafter, may be referred to as MEK) | 160 g |

<Composition B of Toner Image-receiving Layer>

| | |
|---|---|
| Water-dispersible polyester resin (KZA-7049, Unitika Ltd) | 100 g |
| Releasing agent (Table 2) | x g |
| Titanium dioxide (Tipec (registered trademark) A-220, ISHIHARA SANGYO KAISHA, LTD.) | 0.9 g |
| Methanol | 30 g |
| Water | 10 g |

TABLE 2

| | Support | Toner image-receiving layer composition | Releasing agent blended with toner image-receiving layer: Type | Addition amount "x" (g) |
|---|---|---|---|---|
| Example 1 | A | A | carnauva wax | 4 |
| Example 2 | A | A | carnauva wax | 4 |
| Example 3 | A | A | carnauva wax | 4 |
| Example 4 | B | A | carnauva wax | 4 |
| Example 5 | A | A | Simac US-380 (TOAGOSEI, silicone resin) | 15 |

TABLE 2-continued

| | Support | Toner image-receiving layer composition | Releasing agent blended with toner image-receiving layer: Type | Addition amount "x" (g) |
|---|---|---|---|---|
| Example 6 | A | A | Simac US-270 (TOAGOSEI, silicone resin) | 30 |
| Example 7 | A | A | Diaroma SP2105 (Dainichiseika Color & Chemicals Mfg. Co., Ltd., silicone resin) | 40 |
| Example 8 | A | A | Modepa F200 (NOF CORPORATION, fluorinated resin) | 20 |
| Example 9 | A | A | Modepa F200 (NOF CORPORATION, fluorinated resin) | 30 |
| Example 10 | A | A | KF-857 (Shin-Etsu Chemical Co., Ltd., amino-modified silicone resin) | 2 |
| Example 11 | A | B | Simac US-380 (TOAGOSEI, silicone resin) | 15 |
| Example 12 | A | B | Cellosol 524 (Chukyo Yushi Co., Ltd., carnauva wax) | 15 |
| Example 13 | A | B | Cellosol 524 (Chukyo Yushi Co., Ltd., carnauva wax) | 30 |
| Example 14 | A | B | SH7028A (Dow Corning Toray Silicone Co., Ltd., dimethylsiloxane) | 1 |
| Comp. Ex. 1 | A | A | None | 0 |
| Comp. Ex. 2 | B | B | None | 0 |
| Comp. Ex. 3 | B | B | Cellosol 524 (Chukyo Yushi Co., Ltd., carnauva wax) | 15 |
| | | | fluorinated surfactant (Saflon S-141, SEIMI CHEMICAL Co., Ltd.) | 20 |

<Material of a Surface of a Fixing Belt>

The fixing belt was an endless belt comprising a polyimide film as a base material. The polyimide film was coated by the following materials so as to have a thickness of 35 μm.

<Fixing Belt A>

Endless belt coated by HTV silicone rubber with a hardness of 40° (JIS-A), so as to have a thickness of 35 μm.

<Fixing Belt B>

Silicone-crosslinked fluorinated polyether (SIFEL (registered trademark), manufactured by Shin-Etsu Chemical Co., Ltd.)

<Fixing Belt C>

Polytetrafluoroethyleneperfluoroalkylvinyl ether copolymer (manufactured by FUJI KOGYO CO., LTD.)

<Separation Force Test>

Separation force was measured as follows: This will be described referring into FIG. 2.

First, an electrophotographic image-receiving sheet (1) was cut so as to have a width of 10 cm and a length of 20 cm. A fixing belt (13) was cut so as to have a width of 10 cm and a length of 20 cm. The fixing belt surface (13*a*) and electrophotographic image-receiving sheet surface (1*a*) on the toner image-receiving layer side of the support of the electrophotographic image-receiving sheet (1), were brought in contact to obtain a sample. Next, this sample was transported between two pairs of rollers (both of which surfaces were coated with perfluoroalkyl vinyl ether copolymer, had diameter of 40 mm, and a length of 30 cm) at a nip pressure of 100 kg and a velocity of 30 mm/second, so that the fixing belt surface (13*a*) and the electrophotographic image-receiving sheet surface (1*a*) on the toner image-receiving layer side of the support become stuck together. Thereafter, the stuck sample was fixed on a hot plate (90° C. or 50° C.) with the electrophotographic image-receiving sheet underneath, and heated for 30 minutes.

After confirming that the surface of the central part of the sample had reached 90° C. or 50° C., one end of the fixing belt (13) was chucked, and was separated at a velocity of 30 mm/second, so that the angle (θ) of the fixing belt (13) and the separating direction (X) became 90°. At this time, the force applied in the separating direction (X) was measured, using a FORCE GAGE (manufactured by NIDEC-SIMPO Corporation, FCG-2).

<Evaluation of Photographic Image>

An image was formed using an electrophotographic image-receiving sheet manufactured according to the above Examples and Comparative Examples and the fixing belt electrophotography apparatus shown in FIG. 1. Glossiness, offset-resistance, transport properties and deterioration of brilliance in the long run were measured.

The images for printing included a white solid image, a gray image (R=G=B=50% of image), a black image (black 100%), and an image of a female portrait. The color laser printer (DocuPrint C-620), manufactured by Fuji Xerox Corporation, was used as the apparatus for electrophotography, except that an apparatus having one of the fixing belts A to C was used.

In this fixing belt, a transport velocity of the fixing belt (13) was 30 mm/second, a nip pressure between the heat roller (14) and the pressure roller (15) was 0.2 Mpa (2 kgf/cm$^2$). A temperature of the heat roller (14) was set at 155° C., which was the fixing temperature. The electrophotographic image-receiving sheet was cooled down to 60° C. or lower, when separated from the fixing belt (13).

The electrophotographic image-receiving sheet was cut to A4 size. The electrophotographic image-receiving sheet was set in a color laser printer (DocuPrint C-620, manufactured by Fuji Xerox Corporation), and an image from a computer was printed. Four types of images, including a white image, a gray (R=G=B=50% of image) image, a black image, and a female portrait, were printed.

The electrophotography image obtained was evaluated in accordance with the following criteria.

<Offset-resistance>

The above-mentioned electrophotographic image-receiving sheet was transported in the apparatus in an environment at 80% RH, at 30° C. When the sheet was transported normally on the fixing part, the presence or absence of shell-like unevenness on the surface of the image was evaluated according to the following criteria. The results are shown in Table 3. In the present invention, "○ or better" is the level permitted in practice.

[Evaluation Criteria]

◎: no shell-like unevenness appeared at all.

○: although shell-like unevenness appeared very slightly, it was still a permittable level in practice.

Δ: some shell-like unevenness appeared.

x: severe shell-like unevenness appeared.

<Transport Properties>

100 of the electrophotographic image-receiving sheets were continuously supplied using the above printer, and the sum of sheets with defects of supplying, jamming, and poor lamination was counted. The results are shown in Table 3. In the present invention, "2 or less" is the level permitted in practice.

<Brilliance Test>

Brilliance was evaluated by observing the surface state of the toner image-receiving layer, before and after printing. "○" expresses a good brilliance surface, "Δ" expresses slight unevenness which is not very noticeable after printing, and "x" expresses unevenness which remains even after printing. The results are shown in Table 3.

<Decrease of Brilliance in Long Run>

10,000 sheets were continuously supplied, and the decrease in brilliance evaluated according to the following criteria. The results are shown in Table 3.

[Evaluation Criteria]

◎: no decrease at all

○: slight decrease

Δ: some decrease x: obvious decrease

<Surface Tension Measurement>

The surface tension of the polymer used for the toner image-receiving layer in the Examples and Comparative Examples listed for the above toner image-receiving layer composition, and the surface tension of the toner, were measured by the pendant drop method using a PD-Z, manufactured by Kyowa Interface Science Co., LTD. (with thermostat). Specifically, this was done by melting the polymer and toner at the toner fixing temperatures of 130° C., 150° C. and 180° C. to liquefy it, extruding from a needle, and analyzing the form of the liquid drops. The density of the polymer and toner was taken as 1. The results are shown in Table 6. Cyan toner (an aggregated and melted toner having an average particle diameter of 6.5 μm) was employed as the toner. In Table 6, the difference in the surface tension (mN/m) is the value of: (surface tension of the polymer used)−(surface tension of toner) at each toner fixing temperature.

<Contact Angle Measurement>

The contact angles of the surface of the toner image-receiving layer in the image-receiving sheet and the contact angle of the surface of the fixing belt in the Examples and Comparative Examples were measured, using a contact angle meter (CA-A), manufactured by Kyowa Interface Science Co., LTD. The contact angle was measured after placing the toner on the surface of the toner image-receiving layer or the surface of the fixing belt, and melting at the toner fixing temperature of 130° C. and 180° C. The result are shown in Table 5. In Table 5, the difference in the contact angle (°) is the value of:

(contact angle of the surface of the fixing belt)−(contact angle of the surface of the toner image-receiving layer) at each toner fixing temperature.

Cyan toner (an aggregated and melted toner having an average particle diameter of 6.51 μm) was employed as the toner.

<Surface Free Energy Measurement>

The surface free energy of the surface of the toner image-receiving layer in the image-receiving sheet and the surface free energy of the surface of the fixing belt in the Examples and Comparative Examples were measured using a contact angle meter (CA-A), manufactured by Kyowa Interface Science Co., LTD. First, water and methylene iodide were used as probe solution. These solutions were placed on the above-mentioned surface of the toner image-receiving layer or on the surface of the fixing belt. The contact angle was measured in the atmosphere of 25° C./55% RH. The value of the contact angle obtained was substituted in the expanded Fowks equation, and the dispersibility component ($g^d$) and polar component ($g^p$) were calculated. Herein, the dispersibility component and the polar component of surface tension of each solutions are values specific to each solutions. For example, the values given in the Journal of the Institute of Fibers of Japan, 38 (4) and T-147 (1982), were employed. According to thus obtained dispersibility component ($g^d$) and polar component ($g^p$), the solid surface free energy (G) was calculated by the expanded Fowks equation. The results are shown in Table 6.

In the table, the difference in the surface free energy (mN/m) is the value of (surface free energy of the surface of the toner image-receiving layer)−(surface free energy of the surface of the fixing belt).

TABLE 3

| | Material of a surface of Fixing belt | Separation force (N/m) | Separation force Measurement temperature (° C.) | Gloss | Offset--resistance | Transport properties | Decrease of brilliance in the long run | Separation force (N/m) | Separation force Measurement temperature (° C.) |
|---|---|---|---|---|---|---|---|---|---|
| Example 1 | A | 3 | 90 | ○ | ◎ | 0 | ○ | 1.2 | 50 |
| Example 2 | B | 1.5 | 90 | ○ | ◎ | 0 | ◎ | 8.1 | 50 |
| Example 3 | C | 3.1 | 90 | ○ | ○ | 0 | ○ | 1.3 | 50 |
| Example 4 | B | 4 | 90 | Δ | ◎ | 0 | ◎ | 15.2 | 50 |
| Example 5 | B | 8 | 90 | ○ | ◎ | 0 | ◎ | 17.0 | 50 |
| Example 6 | A | 12 | 90 | ○ | ○ | 1 | ○ | 2.5 | 50 |
| Example 7 | B | 7.5 | 90 | ○ | ◎ | 0 | ◎ | 12.0 | 50 |
| Example 8 | A | 9 | 90 | ○ | ○ | 0 | ○ | 2.2 | 50 |
| Example 9 | A | 14 | 90 | ○ | ○ | 2 | ○ | 3.4 | 50 |
| Example 10 | B | 11 | 90 | ○ | ◎ | 1 | ◎ | 19.0 | 50 |
| Example 11 | B | 18 | 90 | ○ | ◎ | 2 | ◎ | 19.1 | 50 |
| Example 12 | B | 2 | 90 | ○ | ◎ | 0 | ◎ | 8.0 | 50 |
| Example 13 | A | 1 | 90 | ○ | ○ | 0 | ○ | 1.5 | 50 |
| Example 14 | A | 6 | 90 | ○ | ○ | 0 | ○ | 1.4 | 50 |
| Comp. Ex. 1 | A | no separation | 90 | Δ | Δ | 12 | Δ | 25 | 50 |

TABLE 3-continued

| | Material of a surface of Fixing belt | Separation force (N/m) | Separation force Measurement temperature (° C.) | Gloss | Offset--resistance | Transport properties | Decrease of brilliance in the long run | Separation force (N/m) | Separation force Measurement temperature (° C.) |
|---|---|---|---|---|---|---|---|---|---|
| Comp. Ex. 2 | B | no separation | 90 | Δ | Δ | 10 | Δ | no separation | 50 |
| Comp. Ex. 3 | B | 0.2 | 90 | X | ◎ | 23 | X | 0.6 | 50 |

TABLE 4

| | Difference in Surface tension (mN/m) (130° C.) | Difference in Surface tension (mN/m) (150° C.) | Difference in Surface tension (mN/m) (180° C.) |
|---|---|---|---|
| Example 1 | 8.3 | 13.0 | 11.2 |
| Example 2 | 8.3 | 13.0 | 11.2 |
| Example 3 | 8.3 | 13.0 | 11.2 |
| Example 4 | 8.3 | 13.0 | 11.2 |
| Example 5 | 8.5 | 10.5 | 10.5 |
| Example 6 | 8.2 | 10.2 | 10.2 |
| Example 7 | 8.0 | 8.8 | 8.2 |
| Example 8 | 8.2 | 10.1 | 10.1 |
| Example 9 | 8.1 | 9.0 | 8.0 |
| Example 10 | 9.4 | 12.8 | 14.4 |
| Example 11 | 8.3 | 10.1 | 9.8 |
| Example 12 | 8.4 | 8.3 | 8.7 |
| Example 13 | 8.3 | 8.1 | 8.4 |
| Example 14 | 9.1 | 11.6 | 12.4 |
| Comp. Ex. 1 | 9.8 | 7.9 | 7.9 |
| Comp. Ex. 2 | 9.9 | 7.8 | 7.8 |
| Comp. Ex. 3 | 7.5 | 7.2 | 7.7 |

TABLE 5

| | Toner used | Difference in Contact angle (°) (130° C.) | Difference in Contact angle (°) (180° C.) |
|---|---|---|---|
| Example 1 | Cyan | 29.0 | 28.5 |
| Example 2 | Cyan | 33.3 | 32.8 |
| Example 3 | Cyan | 31.4 | 30.9 |
| Example 4 | Cyan | 33.3 | 32.8 |
| Example 5 | Cyan | 23.0 | 20.3 |
| Example 6 | Cyan | 10.6 | 11.9 |
| Example 7 | Cyan | 29.9 | 28.6 |
| Example 8 | Cyan | 19.4 | 19.7 |
| Example 9 | Cyan | 32.6 | 31.0 |
| Example 10 | Cyan | 26.0 | 24.1 |
| Example 11 | Cyan | 33.6 | 33.8 |
| Example 12 | Cyan | 39.9 | 35.1 |
| Example 13 | Cyan | 35.5 | 29.8 |
| Example 14 | Cyan | 10.0 | 10.0 |
| Comp. Ex. 1 | Cyan | 9.9 | 9.7 |
| Comp. Ex. 2 | Cyan | 8.9 | 7.2 |
| Comp. Ex. 3 | Cyan | 8.9 | 8.5 |

TABLE 6

| | Difference in dispersion force component ($g^d$) | Difference in polar component ($g^p$) | Difference in surface free energy (G) |
|---|---|---|---|
| Example 1 | 14.9 | 5.1 | 20.0 |
| Example 2 | 17.7 | 7.4 | 25.1 |
| Example 3 | 15.7 | 7.5 | 23.2 |
| Example 4 | 17.7 | 7.4 | 25.1 |
| Example 5 | 9.8 | 14.2 | 24.0 |

TABLE 6-continued

| | Difference in dispersion force component ($g^d$) | Difference in polar component ($g^p$) | Difference in surface free energy (G) |
|---|---|---|---|
| Example 6 | 11.5 | 8.5 | 25.0 |
| Example 7 | 12.8 | 7.4 | 20.2 |
| Example 8 | 17.7 | 5.1 | 22.8 |
| Example 9 | 14.6 | 9.4 | 24.0 |
| Example 10 | 9.8 | 14.2 | 24.0 |
| Example 11 | 16.6 | 5.6 | 22.2 |
| Example 12 | 13.2 | 7.8 | 21.0 |
| Example 13 | 11.4 | 9.3 | 20.7 |
| Example 14 | 16.0 | 4.8 | 20.8 |
| Comp. Ex. 1 | 17.9 | 0.3 | 18.2 |
| Comp. Ex. 2 | 17.4 | 2.4 | 19.8 |
| Comp. Ex. 3 | 3.3 | −1.5 | 1.8 |

From the results shown in Table 3, the surface of the image-receiving sheet shown in the examples of the present invention did not have roughness or image defects, and its brittleness was also good.

Also, after printed, images can also be printed on the back surface.

All of the samples could be transported in the apparatus, when printed by commercial color laser printers, such as full color laser printers (DC-2220, DCC-400CP/320CP, DCC-500CP) manufactured by Fuji Xerox Co., Ltd., color copiers (DocuColor 5750) manufactured by Xerox Corporation, LP-8000C by Seiko Epson Coration, COLOR PAGEPRESTO N4-ST by Casio Denshi Kogyo., Co., Ltd., COLOR LASER SHOT LBP-2030 by Canon, Inc., Japan magicolor 2 by Minolta-QMS K. K., Color LaserBitKL-2010 by Konica Corporation, JX-8200 by SHARP Corporation, BEAMSTAR-RW by Hitachi Ltd., or Color Page Pro PS by Minolta Co., Ltd. Identical results to those of Table 3 were obtained.

According to the present invention, by combining a specific materials for belt with the wax material of the toner image-receiving layer, a electrophotographic image-receiving sheet is obtained, which gives less soiling of the belt during transfer, much improved long-run properties, ability to be transported in an oil-less machine without fixing oil, and excellent brilliance as well as a photographic features.

What is claimed is:

1. An image-forming process comprising the steps of:

forming a toner image on an electrophotographic image-receiving sheet, which comprises a support and a toner-receiving layer which contains a polymer on the support;

heating and pressuring a surface of the electrophotographic image-receiving sheet on which the toner image is formed with a fixing belt and a roller;

cooling the surface, so as to separate the surface from the fixing belt; and peeling a surface of the toner receiving layer of the electrophotographic image-receiving sheet from a surface of the fixing belt with a separation force of 1 N/m to 20 N/m, when a temperature at the surface of the electrophotographic image-receiving sheet is one of 50° C. and 90° C.

2. An image-forming process according to claim 1, wherein the step of cooling is carried out by cooling the toner image to one of a melting point or lower of a binder resin contained in a toner of the toner image, and a glass transition temperature +10° C. or lower of the binder resin.

3. An image-forming process according to claim 1, wherein the toner image-receiving layer contains a polymer, and a surface tension of the polymer ($\gamma_p$) (mN/m) at a toner fixing temperature, and a surface tension of the toner ($\gamma_t$) (mN/m) at the toner fixing temperature, satisfy the following relation of:

$$\gamma_p-\gamma_t \geqq 8.$$

4. An image-forming process according to claim 1, wherein the contact angle ($\theta_1$) (°) of molten toner at fixing temperature towards the surface of the toner image-receiving layer, and the contact angle ($\theta_2$) (°) of molten toner at fixing temperature towards the surface of the fixing belt, satisfy the following relation of:

$$\theta_2-\theta_1 \geqq 10.$$

5. An image-forming process according to claim 1, wherein the surface free energy ($G_1$) (mN/m) of the surface of the toner image-receiving layer, and the surface free energy ($G_2$) (mN/m) of the surface of the fixing belt satisfy the following relation of:

$$G_1-G_2 \geqq 10.$$

6. An image-forming process according to claim 1, wherein the value ($g^p{}_1$(mN/m) of a polar component of the surface free energy of at the surface of the toner image-receiving layer, and the value ($g^p{}_2$) (mN/m) of the polar component of the surface free energy at the surface of the fixing belt, satisfy the following relation of:

$$g^p{}_1-g^p{}_2 \geqq 0.3.$$

7. An image-forming process according to claim 1, wherein a material of the surface of the fixing belt is selected at least from silicone rubber, fluorinated rubber, silicone resin, and fluorinated resin.

8. An image-forming process according to claim 1, wherein the surface of the fixing belt has a layer of fluorocarbon siloxane rubber having a uniform thickness.

9. An image-forming process according to claim 8, wherein the fluorocarbon siloxane rubber has at least one of a perfluoroalkylether group and a perfluoroalkyl group in a main chain thereof.

10. An image-forming process according to claim 1, wherein the surface of the fixing belt has a layer of silicone rubber having a uniform thickness, and a layer of fluorocarbon siloxane rubber having a uniform thickness which is formed on the layer of silicone rubber.

11. An image-forming process according to claim 10, wherein the fluorocarbon siloxane rubber has at least one selected from the group consisting of a perfluoroalkylether group and a perfluoroalkyl group in a main chain thereof.

12. An image-forming process according to claim 1, wherein at least one layer including the toner image-receiving layer which is formed on a surface of the support contains at least one type of releasing agent selected from a silicone compound, a fluorine compound, wax, and a matting agent.

13. An image-forming process according to claim 12, wherein a content of the releasing agent is 0.1% by mass to 20% by mass, relative to a mass of at least one layer including the toner image-receiving layer which is formed on a surface of the support.

14. An image forming process according to claim 12, wherein the wax is natural wax, and the natural wax is one of vegetable wax, mineral wax, and petroleum wax.

15. An image-forming process according to claim 14, wherein the vegetable wax is carnauba wax having a melting point of 70° C. to 95° C.

16. An image-forming process according to claim 14, wherein the mineral wax is montan wax having a melting point of 70° C. to 95° C.

17. An image-forming process according to claim 1, wherein the polymer is a self-dispersing aqueous polyester resin emulsion which satisfies the following properties (1) to (4):

(1) Number average molecular weight (Mn)=5000 to 10000;

(2) Molecular weight distribution (weight average molecular weight/number average molecular weight)≦4;

(3) Glass transition temperature (Tg)=40° C. to 100° C.; and (4) Volume average particle diameter=20 nmϕ to 200 nmϕ.

18. An image-forming process according to claim 1, the support is selected from raw paper, synthetic paper, a synthetic resin sheet, a coated sheet, and a laminated sheet.

19. An image-forming process according to claim 1, wherein the toner receiving layer receives toners, and the toners contain binder resin, and a colorant, and the toners have an average particle diameter of 0.5 μm to 10 μm, and a volume average particle size distribution index (GSDv) of 1.3 or less.

20. An image-forming process according to claim 19, wherein a ratio of the volume average particle size distribution index (GSDv) and a number average particle size distribution index (GSDn) is 0.95 or more.

21. An image-forming process according to claim 19, wherein the toners contain binder resin and a colorant, the toners have an average particle diameter of 0.5 μm to 10 μm, and an average value of a formation friction expressed by the following Formula is 1.00 to 1.50:

$$\text{Formation coefficient}=(\pi\times L^2)/(4\times S)$$

(where "L" expresses a maximum length of a toner particle, and "S" expresses a projected area of a toner particle).

22. An image-forming process according to claim 19, wherein the toners are manufactured by a process comprising the steps of:

(i) forming aggregated particles in a dispersion in which resin particles are dispersed, so as to prepare aggregated particle dispersion;

(ii) adding and mixing a fine particle dispersion in which fine particles are dispersed, into the aggregated particle dispersion, so as to form adhesion particles in which the aggregated particles adhere the fine particles; and (iii) heating and fusing the adhesion particles, so as to form toner particles.

23. An image-forming process comprising the steps of: forming a toner image on an electrophotographic image-receiving sheet, which comprises a support and a toner-receiving layer which contains a polymer on the support;

fixing the toner image with a heat roller;

heating and pressuring a surface of the electrophotographic image-receiving sheet on which the toner image is formed with a fixing belt and a roller;

cooling the surface, so as to separate the surface from the fixing belt, and peeling a surface of the toner receiving layer of the electrophotographic image-receiving sheet from a surface of the fixing belt with a separation force of 1 N/m to 20 N/m, when a temperature at the surface of the electrophotographic image-receiving sheet is one of 50° C. and 90° C.

24. An image-forming process according to claim 23, wherein the step of cooling is carried out by cooling the toner image to one of a melting point or lower of a binder resin contained in a toner of the toner image, and a glass transition temperature +10° C. or lower of the binder resin.

* * * * *